US005323935A

United States Patent [19]

Gosselin et al.

[11] Patent Number: 5,323,935

[45] Date of Patent: Jun. 28, 1994

[54] CONSUMER PRODUCT PACKAGE INCORPORATING A SPRAY DEVICE UTILIZING LARGE DIAMETER BUBBLES

[75] Inventors: Peter G. Gosselin, Cincinnati; Mark T. Lund, West Chester, both of Ohio; Paul E. Sojka, West Lafayette; Arthur H. LeFebvre, Lafayette, both of Ind.

[73] Assignee: The Procter & Gamble Company, Cincinnati, Ohio

[21] Appl. No.: 978,850

[22] Filed: Nov. 19, 1992

Related U.S. Application Data

[63] Continuation-in-part of Ser. No. 839,648, Feb. 21, 1992, abandoned.

[51] Int. Cl.[5] ..... B65D 83/00

[52] U.S. Cl. ..... 222/401; 222/402.18; 239/428.5; 239/369; 239/434

[58] Field of Search ..... 222/321, 401, 394, 402.1, 222/402.24, 402.18, 634, 635, 145; 239/337, 340, 369, 428.5, 434

[56] References Cited

U.S. PATENT DOCUMENTS

| | | | |
|---|---|---|---|
| 1,992,851 | 2/1935 | Adams | 299/140 |
| 2,518,259 | 8/1950 | Stevenson | 222/394 |
| 2,746,796 | 5/1956 | Germain | 299/95 |
| 3,130,914 | 4/1964 | Carkin et al. | 239/425 |
| 3,372,845 | 3/1968 | Frangos | 222/402.18 |
| 3,478,933 | 11/1969 | Rousselot | 222/635 |
| 3,544,258 | 12/1970 | Presant et al. | 222/192 |
| 3,598,292 | 8/1971 | Kiliany | 222/635 |
| 3,644,210 | 2/1972 | Crotty et al. | 252/548 |
| 3,690,515 | 9/1972 | Ewald | 222/136 |
| 3,692,244 | 9/1972 | Lincoln | 239/419 |
| 3,704,814 | 12/1972 | Ruscitti | 222/145 |
| 3,733,031 | 5/1973 | Marand | 239/349 |
| 3,764,069 | 10/1973 | Runstadler, Jr. et al. | 239/8 |
| 3,786,963 | 1/1974 | Metzler, III | 222/136 |
| 3,851,799 | 12/1974 | Paoletti | 222/145 |
| 3,945,574 | 3/1976 | Polnauer et al. | 239/404 |
| 3,955,720 | 5/1976 | Malone | 222/396 |
| 4,077,442 | 3/1978 | Olofsson | 141/20 |
| 4,165,025 | 8/1979 | Mascia et al. | 222/401 |
| 4,174,811 | 11/1979 | Binder et al. | 239/308 |
| 4,175,706 | 11/1979 | Gerstmann | 239/414 |
| 4,187,985 | 2/1980 | Goth | 239/428.5 X |
| 4,227,631 | 10/1980 | Schneider | 222/635 |

(List continued on next page.)

FOREIGN PATENT DOCUMENTS

| | | | |
|---|---|---|---|
| 2024335 | 1/1980 | United Kingdom | 83/14 |
| 1597147 | 9/1981 | United Kingdom | 83/14 |
| WO 90/05580 | 5/1990 | World Int. Prop. O. | 83/14 |

OTHER PUBLICATIONS

"A Novel Method of Atomization with Potential Gas Turbine Applicants", by Lefebvre, Arthur H., Oct. 1988, pp. 353–362.

"Effervescent Atomization of High Viscosity Fluids: Part I. Newtonian Liquids", presented by Harry N. Buckner and Paul E. Sojka, May 16–17, 1989.

(List continued on next page.)

*Primary Examiner*—Gregory L. Huson

*Attorney, Agent, or Firm*—E. Kelly Linman; Michael E. Hilton; John M. Howell

[57] ABSTRACT

A consumer product passage incorporating a mixing chamber for mixing air and liquid. Consumer packages of the present invention are capable of providing excellent spray qualities at typical consumer product flow rates (e.g., less than about 1.0 cubic centimeters per second) while simultaneously maintaining relatively low air to liquid ratios (e.g., less than about 0.06:1 on a mass basis) and relatively low pressures (e.g., less than about 50 psi). The package of the present invention also offers significant environmental and safety advantages. For example, it does not depend upon dissolved propellants; and it permits the use of water in place of volatile solvents as thinning agents since high surface tension fluids are actually sprayed better. Several packages of the present invention are illustrated, including a standard aerosol version, pump and spray versions, and a finger pump version.

26 Claims, 15 Drawing Sheets

U.S. PATENT DOCUMENTS

| | | | |
|---|---|---|---|
| 4,247,025 | 1/1981 | Gailitis | 222/402.18 |
| 4,260,110 | 4/1981 | Werding | 239/404 |
| 4,265,373 | 5/1981 | Stoody | 222/94 |
| 4,284,239 | 8/1981 | Ikeucki | 239/8 |
| 4,343,434 | 8/1982 | Haruch | 239/390 |
| 4,396,152 | 8/1983 | Abplanalp | 239/337 |
| 4,417,674 | 11/1983 | Guiffredi | 222/402.18 |
| 4,431,119 | 2/1984 | Stoody | 222/129 |
| 4,492,320 | 1/1985 | Tada | 222/398 |
| 4,516,728 | 5/1985 | Whinfrey | 239/399 |
| 4,601,428 | 7/1986 | Kurogo | 239/427.3 |
| 4,632,314 | 12/1986 | Smith et al. | 239/433 |
| 4,699,587 | 10/1987 | Shimoda et al. | 431/354 |
| 4,708,293 | 11/1987 | Graziadio et al. | 239/427 |
| 4,779,803 | 10/1988 | Corsette | 239/428.5 |
| 4,979,652 | 12/1990 | Saulle | 222/402.16 |
| 4,989,675 | 2/1991 | Papavergos | 169/14 |
| 5,020,696 | 6/1991 | Cater | 222/321 |
| 5,080,266 | 1/1992 | O'Neill | 222/635 |

OTHER PUBLICATIONS

"The Effervescent Atomization of High Viscosity, Non-Newtonian Multiphase Fluids", by Prof. Paul E. Sojka Dec., 1990.

"Spray Characteristics of Aerated-Liquid Pressure Atomizers", by A. H. Lefebvre, X. F. Wang, and C. A. Martin, Jul. 1988.

"Effervescent Atomization of Coal-Water Slurries", by H. N. Buckner, Paul E. Sojka, and A. H. Lefebvre, 1990, pp. 105-108.

"Influence of Gas Injector Geometry on Atomization Performance of Aerated Liquid Nozzles", by X. F. Wang, J. S. Chin, and A. H. Lefebvre, Aug., 1987, pp. 11-18.

"Influence of Ambient Air Pressure on Effervescent Atomization", by S. K. Chen, A. H. Lefebvre and J. Rollbuhler, jan. 6-9, 1992.

"Studies on Aerated-Liquid Atomization", by T. C. Roesler and A. H. Lefebvre, Dec. 13, 1987, pp. 221-229.

"Compressible Flow of an Air-Water Mixture Through a Vertical, Two-Dimensional, Converging-Diverging Nozzle", by J. F. Muir and R. Eichhorn.

CONSUMER PRODUCT PACKAGE INCORPORATING A SPRAY DEVICE UTILIZING LARGE DIAMETER BUBBLES

The present application is a continuation-in-part of the parent case Ser. No. 07/839,648, filed Feb. 21, 1992, which has since been abandoned.

BACKGROUND OF THE INVENTION

1. Field of the Invention

The present invention relates to consumer product packages which incorporate spray devices; and more particularly, to such consumer product packages with spray devices which utilize air to aid small particle spray formation.

2. Description of the Prior Art

It has long been desirable to provide consumer product packages with spray devices which produce excellent spray qualities. Characteristics of spray quality include mean droplet size (e.g., as measured by the Sauter mean diameter); droplet size distribution width; spray velocity and clean starting and stopping (i.e., no spitting or dripping). Historically, aerosol spray packages have utilized partially dissolved propellants to pressurize the package. Atomization is primarily driven by the propellant dissolved in the product "boiling off" upon exiting the spray device. Unfortunately, traditional dissolved propellants have been the subject of environmental concerns for many years now.

Spray devices have also utilized vapor tap valves which mix propellant vapor with the liquid. This improves atomization quality. It is believed that the vapor provides bubbles which function as nucleation sites for the dissolved propellant. Exemplary vapor tap valves are disclosed in U.S. Pat. No. 2,746,796 issued to St. Germain on Aug. 5, 1953; U.S. Pat. No. 3,544,258 issued on Aug. 19, 1963 to Presant et. al.; U.S. Pat. No. 4,227,631 issued on Oct. 14, 1980 to Schneider; and U.S. Pat. No. 4,417,674 issued to Giuffredi on Nov. 29, 1983. One disadvantage of vapor taps is they utilize, and therefore, release even more of the propellants of environmental concern.

Spray devices have also included passages which pass the liquid through a swirl chamber immediately prior to its exiting the discharge orifice. The swirl chamber causes the liquid to exit the discharge orifice in a thin walled-expanding cone configuration which aids atomization. Swirl chambers are often found on standard aerosol packages and are usually found on mechanical pumps. Disadvantages of swirl chambers include manufacturing complexities; the requirement of relatively high pressures due to the energy losses caused by the small channels of the swirl chamber; and difficulties atomizing relatively viscous fluids.

Several spray device designs combine more than one atomization mechanism. For example, many spray devices combine the vapor tap approach and the swirl chamber approach. Exemplary combination designs include U.S. Pat. No. 4,247,025 which issued to Gailitis on Jan. 27, 1981; U.S. Pat. No. 4,260,110 which issued on Apr. 7, 1981 to Werding; and U.S. Pat. No. 4,396,152 which issued on Aug. 2, 1983 to Abplanalp. Of course, these combination designs have the disadvantages of each of the features they incorporate.

One other approach which has been tried with consumer product packages involves mixing air with the liquid in such a manner as to reduce the velocity at which choke flow occurs. Then the two phase (i.e., air and liquid) mixture is passed through one or more restrictions such that choke flow occurs, thereby providing a shock wave to help atomize the liquid. One such example is illustrated in a PCT patent application published under number WO 90/05580 on May 31, 1990. One major disadvantage to utilization of the choked flow phenomenon is the large amount of energy required. This means the driving pressure in the package must be relatively high for flow rates applicable to consumer product packages.

Outside the area of consumer packages, air has been utilized (sometimes in conjunction with swirl or turbulence generating geometries) at great velocity and/or in great quantities to provide kinetic energy to the liquid to aid in atomization. Examples include the devices disclosed in U.S. Pat. No. 3,130,914 issued to Catkin et. al. on Apr. 28, 1964; U.S. Pat. No. 3,764,069 issued on Oct. 9, 1973 to Runstadler, Jr. et al.; U.S. Pat. No. 4,284,239 issued to Ikeuchi on Aug. 18, 1981; and U.S. Pat. No. 4,632,314 issued to Smith et al. on Dec. 30, 1986. However, the relatively high pressures necessary to provide high velocity air and/or the relatively large quantities of air necessary, inhibit utilization of these techniques in consumer product packages; particularly when low container pressure and/or low air-to-liquid ratio is desired.

Additional work has also been performed outside the area of consumer product packages with spray devices which mix air and liquid prior to the final exit orifice. Much of this work, for example, has been done by the faculty and students of Purdue University. This work was typically performed at much higher pressures, flow rates and at air-to-liquid ratios greater than those desirable for consumer product applications. In fact, most of this work was done at combinations of such high flow rates and air-to-liquid ratios that choked flow occurred resulting in shock waves. Although some of this work was done at either low pressure or low air-to-liquid ratios, none of the work was done here both were simultaneously low and consumer product flow rates were utilized.

None of the spray devices discussed above provide all of the advantages of the present invention. For example, consumer product spray packages of the present invention does not depend upon mechanisms like swirl chambers and choked flow. Consequently, excellent spray qualities are provided at consumer product flow rates while simultaneously maintaining relatively low air-to-liquid ratios and relatively low pressures.

In conjunction with the advantages discussed above, the spray device of the present invention offers significant environmental advantages. The product being sprayed with the spray device of the present invention does not have propellant dissolved therein. Consequently, the viscosity of the propellantless liquid are typically higher and the spray device of the present invention produces excellent spray qualities with higher viscosity liquids; e.g., above about 10 cP. Furthermore, products are typically formulated to include volatile solvents to reduce the viscosity of the product. Like the propellants discussed above, these volatile solvents are of concern from environmental and safety standpoints. The present invention permits at least partial replacement of these volatile solvents with water to reduce viscosity. One reason water has not been utilized extensively in the past to reduce viscosity is because it typically increases the surface tension of the product which is generally thought to produce poorer spray qualities. However, spray devices of the present invention actually produce better spray qualities with higher surface tension liquids.

SUMMARY OF THE INVENTION

In accordance with one aspect of the present invention a consumer product spray package for spraying consumer products incorporating a mixing chamber for mixing air and liquid is provided. The package includes a liquid and an air pressure chamber located in communication with the mixing chamber via a liquid passage and a air passage, respectively. The liquid and the air pressure chambers have a pressure of less than about 50 psi immediately prior to dispensing. The liquid passage and the air passage are sized to provide air-to-liquid ratios to the mixing chamber between about 0.06:1 and about 0.01:1 on a mass basis.

Also, included is a valve means located along the liquid passage and the air passage intermediate the liquid and the air pressure chambers and the mixing chamber. The valve means selectively opens and closes the liquid passage and the air passage, respectively.

The package also comprehends an actuator which includes an outer housing which has a large cavity therein. The outer housing also includes a portion of the liquid passage, a portion of the air passage and a final exit orifice. Each of these provide separate communication to the large cavity through the outer housing, In addition, the final exit orifice is dimensioned to provide liquid flow rates less than about 1.0 cubic centimeter per second.

The actuator also includes an inner housing located within the large cavity of the outer housing. The exterior dimensions of the inner housing are adapted to provide a portion of either the liquid passage or the air passage in a gap between the inner housing and the outer housing. The mixing chamber is located in that portion of the gap closest to the final exit orifice. The inner housing has a small cavity therein providing a portion of the other of the liquid passage or the air passage. The inner housing also including an injection means providing a portion of the air passage between the small cavity of the inner housing and the mixing chamber. The injection means is adapted for forming bubbles such that substantially all the bubbles have diameters which are greater than about the diameter of the exit orifice.

In accordance with another aspect of the present invention a package for spraying consumer products incorporating a mixing chamber for mixing air and liquid is provided. The package includes a liquid chamber located in communication with the mixing chamber via a liquid passage. In addition, a valve means located along the liquid passage, intermediate the liquid chamber and the mixing chamber versus electively opening and closing the liquid passage is included. Also included is an actuator having an outer housing with the mixing chamber located therein. The outer housing also includes a portion of the liquid passage, a portion of an air passage and a final exit orifice, each of which provides separate fluid communication with the mixing chamber. The mixing chamber is in the shape of venturi passage with a liquid passage communicating therewith to pass the liquid longitudinally therethrough. The air passage communicates with the mixing chamber through an air injection means at substantially the midpoint of the venturi such that the pressure of the liquid is reduced to below atmospheric pressure and such that air directly from the atmosphere enters the liquid stream.

In accordance with another aspect of the present invention a package for spraying consumer products incorporating a mixing chamber for mixing air and liquid is provided. The package includes a means for delivering the liquid to the mixing chamber. Also included is a means for separately delivering the air to the mixing chamber through an air injection means. The package also includes an exit orifice through which the air and liquid from the mixing chamber exits the package. The distance from the injection means to the exit orifice expressed in terms of a mean flow path is less than the distance at which bubbles have a chance to coalesce significantly. The exit orifice, the liquid delivery means, and the air delivery means cooperate to provide a total mass flow rate less than about 1.0 cubic centimeter per second, a mass flow rate of the liquid, and mass flow rate of the air such that along with the cross-section area of the mixing chamber, the surface tension of the liquid, the viscosity of the liquid, the density of the liquid and the density of the air the plot of $G_A/\lambda$ versus$(GL\cdot\lambda\cdot\Psi)/G_A$ on the graph of FIG. 6 falls outside the bubbly flow regime and the slug flow regime.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENT

Figure 1:
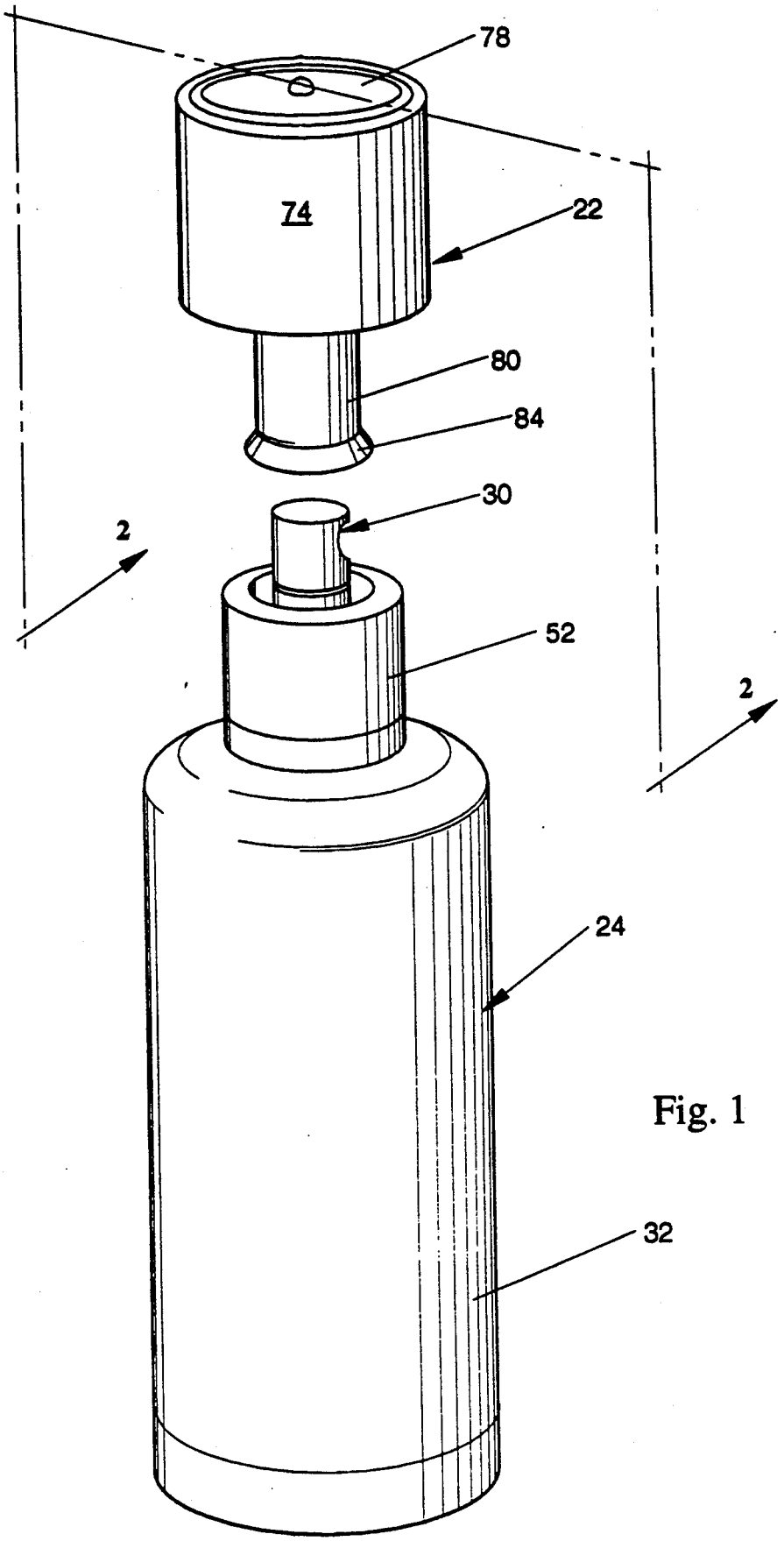
FIG. 1 is an exploded perspective view of a preferred embodiment of a pump and spray consumer product package of the present invention.
Figure 2:
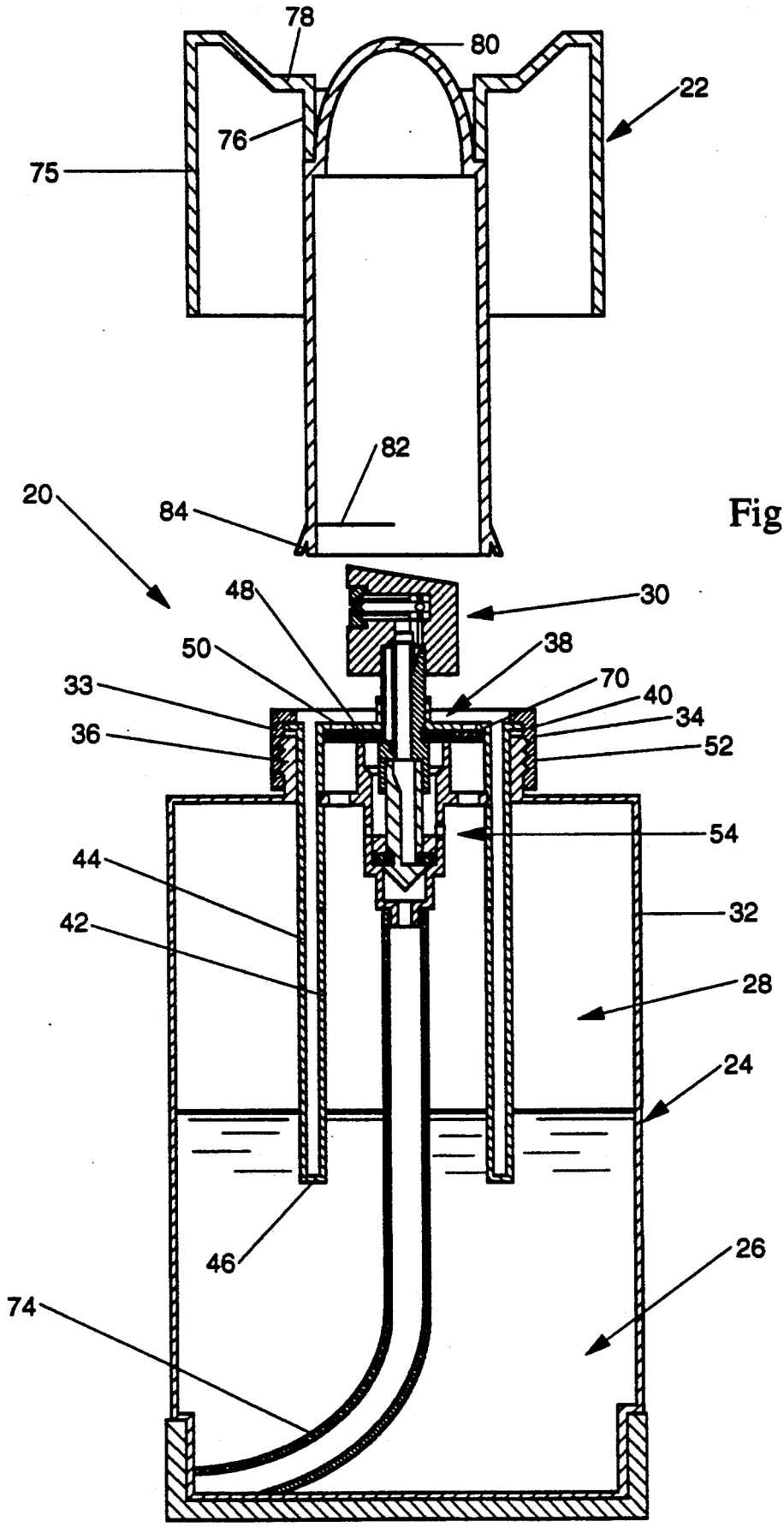
FIG. 2 is an exploded cross-sectional view taken along line 2—2 of FIG. 1.

A preferred consumer product spray package of the present invention, indicated generally as 20, is seen in FIGS. 1 and 2. The package 20 of this embodiment includes a overcap 22 and a container 24 which houses a liquid pressure chamber 26 and an air pressure chamber 28. The term "air" as used herein is intended to encompass any substance which may be utilized as a propellant which is not dissolved in the liquid at the point of mixing in the actuator 30. The phrase "pressure chamber" as used herein is simply a chamber in which the substance (i.e., air or liquid) is housed at a relatively low predetermined pressure prior to opening of the corresponding valve. The relatively low predetermined pressure in the air and the liquid pressure chambers is less than about 50 psi; and more preferably, between about 30 psi and about 10 psi. In one embodiment disclosed herein, the atmosphere functions as the air pressure chamber.

The air pressure chamber 28 and the liquid pressure chamber 26 of this embodiment are contained in the same compartment with the air chamber 28 in the headspace over the liquid chamber 26. Examples of other such containers include conventional aerosol containers; pump and spray containers as disclosed, e.g., in U.S. Pat. No. 4,165,025 which issued on Au. 21, 1979 to Mascia, U.S. Pat. No. 4,492,320 which issued to Tada on Jan. 8, 1985, and in U.S. Pat. No. 4,077,442 which issued to Olofsson on Mar. 7, 1978. Alternatively, the air pressure chamber and the liquid pressure chamber may be in separate compartments, e.g., as disclosed in FIG. 5 of Olofsson and the discussion relative thereto. The separate chambers may be necessary if the air interacts disadvantageously with the liquid product; or if the product includes both the liquid component and the air component, and the advantages of the product are offered by the interaction between the air and liquid components upon mixing.

Referring to FIG. 2, the illustrated spray package 20 includes a bottle 32 which has screw threads 34 located on the exterior of a wide mouth neck 36. An inner core 38 has a horizontal annular wall 40 which rests on the top of the wide mouth neck 36 of the bottle 32. Depending from this horizontal wall 40 is a series of vertical and horizontal walls which connect to form two concentric cylindrical walls, 42 and 44, connected by a lower horizontal wall 46. The inner cylindrical wall 42 is closed by a top wall 48 which has a series of apertures 50 therein. An attachment ring 52 provides a means for attaching the inner core 38 to the bottle 32 via screw threads 54 which cooperate with the screw threads 34 of the bottle 32. An o-ring 33 may be located between the horizontal wall 40 and the wide mouth neck 36 to aid sealing.

Figure 4:
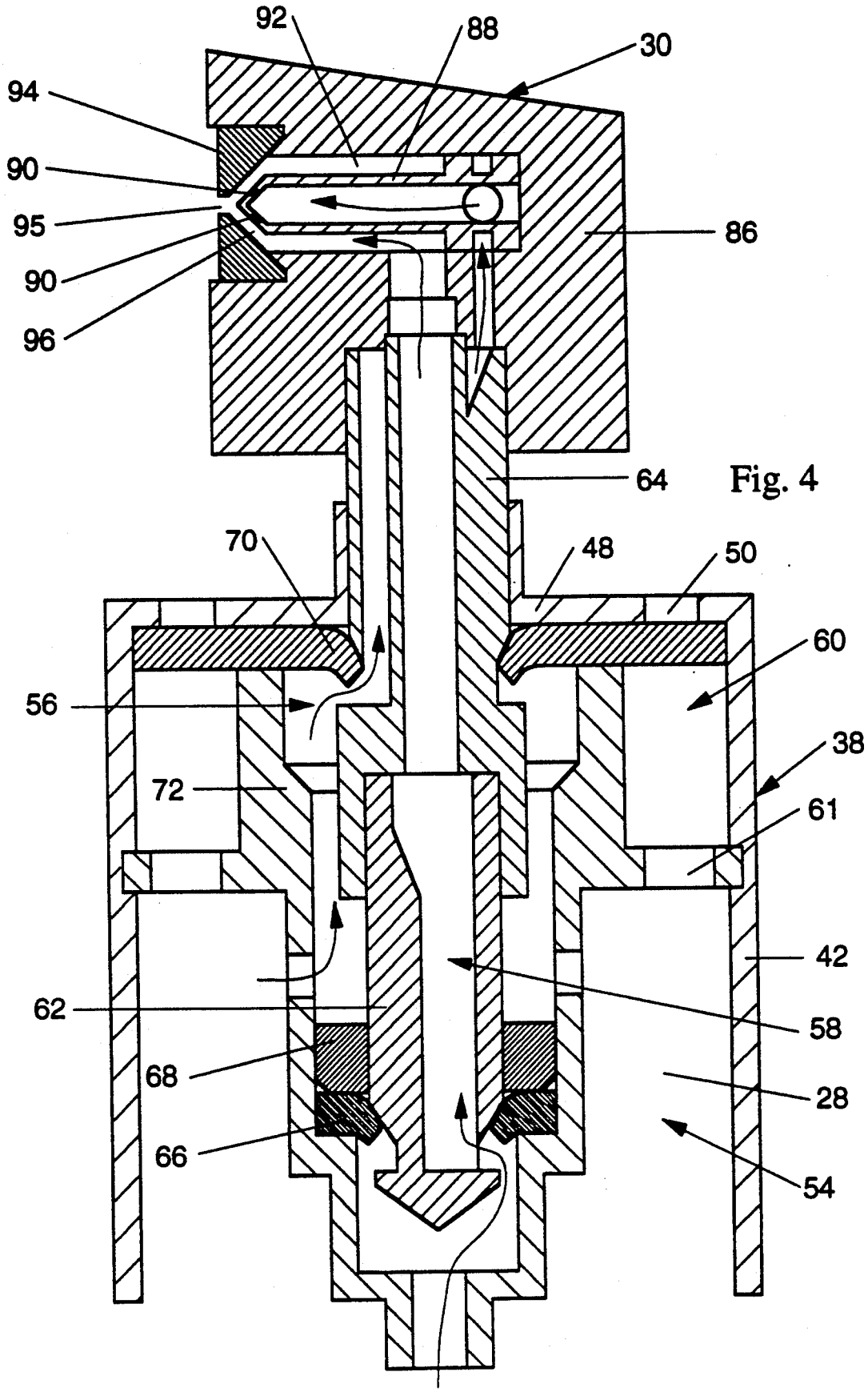
FIG. 4 is an enlarged fragmentary cross-sectional view similar to FIG. 3 illustrating the actuator and valve assembly with the air and liquid exit passages open during spraying.
Figure 5:
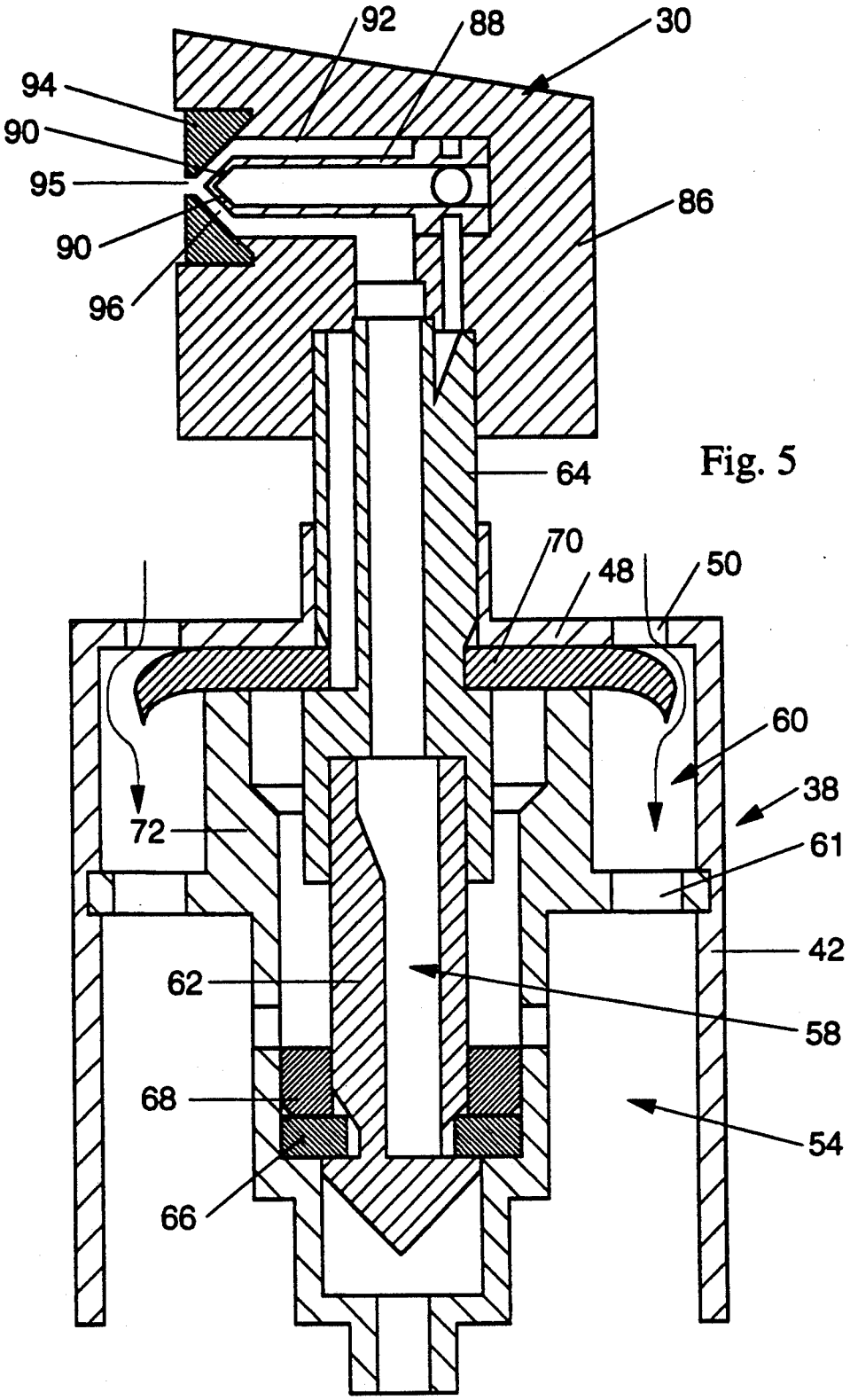
FIG. 5 is an enlarged fragmentary cross-sectional view similar to FIG. 3 illustrating the valve assembly with the air inlet passage open during container pressurization.

The inner core 38 is adapted to house the bulk of the valve assembly 54 within the inner concentric cylindrical wall 42. The valve assembly 54 of this embodiment is a triple valve assembly. In other words, the valve assembly 54 operates to provide an on/off mechanism for three different passages; (as seen in FIG. 4 an air passage 56 and a liquid passage 58 for spraying, and (as seen in FIG. 5) an air inlet passage 60 for pressurizing the air and liquid chambers, 28 and 26, respectively.

Figure 3:
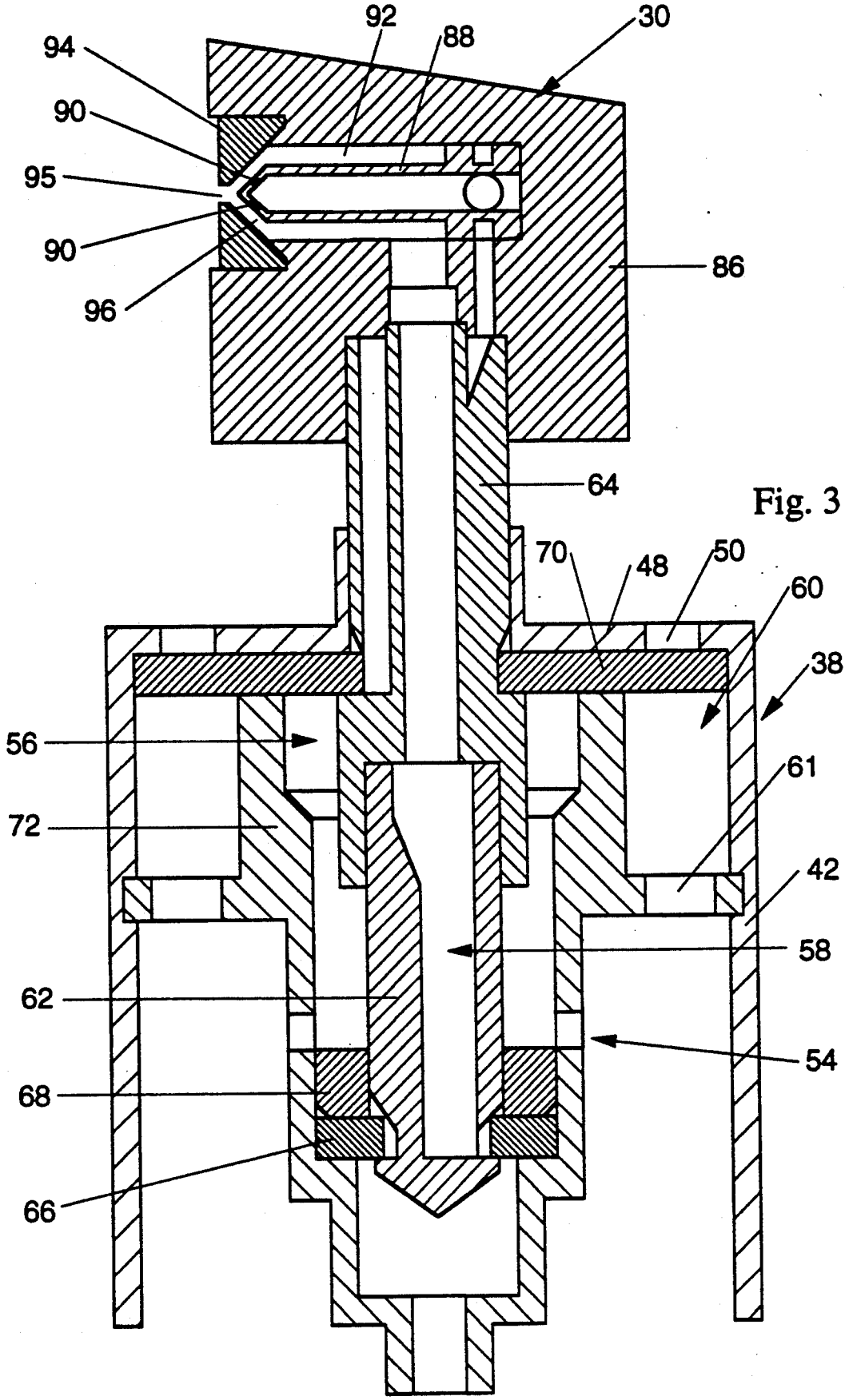
FIG. 3 is an enlarged fragmentary cross-sectional view of the actuator and valve assembly of the FIG. 2 also taken along line 2—2 of FIG. 1.

Referring to FIG. 3, the valve assembly 54 operates to substantially simultaneously (i.e., within the accuracy normally found in such valves) open and close the liquid passage 58 and the air passage 56 to permit product to be sprayed from the package 20. Although other valve assemblies which do not substantially simultaneously open and close both passages may be utilized; this substantially simultaneous operation is preferred. Advantages of the substantially simultaneous operation include ease of design and manufacture, and cleaner starting and stopping so that it permits the capillary action discussed hereinafter to work.

Perhaps more importantly, the valve assembly 54 maintains the liquid flow and the air flow in separate passages, 56 and 58, respectively, throughout the valve assembly 54. (The separate passages, 56 and 58, enable the flows to remain separate in the actuator 30 until just prior to the final orifice 95, as discussed hereinafter.) Exemplary valves which simultaneously open and close a liquid passage and a air passage and maintain the flows separate throughout the valve assembly are disclosed in U.S. Pat. No. 4,227,631 issued to Schneider on Oct. 14, 1980; and U.S. Pat. No. 4,396,152 issued to Abplanalp on Aug. 2, 1983, the disclosures of which are hereby incorporated herein by reference.

The illustrated valve assembly 54 includes a lower reciprocating element 62 and an upper reciprocating element 64 which are friction fit together. An annular resilient member 66 is located around the lower reciprocating element 62 in a recess such that the inner periphery thereof operates to selectively seal or open the liquid passage 58. The outer periphery of this annular resilient member 66 is held in place by a friction fit retaining member 68. Similarly, an annular resilient member 70 is located around the upper reciprocating element 64 in a recess such that the inner periphery thereof operates to selectively seal or open the air passage 56. The central radial portion of this annular resilient member 70 is held in place against the top wall 48 of the inner core 38 by an outer housing 72 (permitting the outer radial portion of the annular member 70 to selectively seal or open the air inlet passage 60 as discussed hereinafter). The outer housing 72 is snap-fit into place into a groove in the inner surface of the inner cylindrical wall 42 of the inner core 38.

As seen in FIG. 4, as the actuator 30 is pressed downwardly the annular resilient member 70 permits the air in the air pressure chamber 28, i.e., the headspace, to flow into the air passage 56 of the upper reciprocating element 64 of the valve assembly 54. Substantially simultaneously, the liquid in the liquid pressure chamber 26 of the container 24 flows up a diptube 74 (seen in FIG. 2) and is permitted by the annular resilient member 66 to flow into the liquid passage 58 of the upper reciprocating element 64. Thus, both the air and the liquid are permitted to separately pass completely through the valve assembly 54. Upon leaving the valve assembly 54 the separate passages, 56 and 58, continue through the actuator 30 until just prior to exiting, as will be discussed hereinafter.

As previously mentioned, the valve assembly 54 also operates to open and close an air inlet passage 60. The air inlet passage 60 operates to admit air into the container 24, thereby pressurizing the air and liquid chambers, 26 and 28, respectively. The overcap 22 is utilized in this pressurization process. As seen in FIG. 2, the illustrated overcap 22 includes an outer part having an outer cylindrical wall 75 and an inner concentric cylindrical wall 76 connected via a top wall 78. An inner part is a cylindrical tube 80 which is closed at the top end. This cylindrical tube 80 includes a recessed portion near its top end which cooperates with the inner cylindrical wall 76 to snap-fit the outer part and the inner part together. At the lower end of the inner tube 80 is a slit 82 which extends approximately half-way around the cylindrical wall just above a cup seal wall 84.

Referring to FIG. 2, pressurization of the liquid and the air pressure chambers, 26 and 28, respectively, is accomplished by reciprocating the overcap 22 with respect to the container 24. The outer diameter of the cup seal wall 84 of the overcap 22 is substantially the same as the inner diameter of the outer cylindrical wall 44 of the inner core 38. As the overcap 22 is reciprocated down over the inner core 38, air occupying the space between the inner core 38 and the tube 80 of the overcap 22 is compressed.

Referring to FIG. 5, the compressed air is forced into the pressure chambers through the apertures 50 and around the outer periphery of the annular resilient member 70 and into the air and liquid pressure chambers. Returning to FIG. 2, as the overcap 22 is reciprocated up, the friction between the cup seal wall 84 of the overcap 22 and the cylindrical wall 44 of the inner core 36 cause the slit 82 to open up which admits air into the expanding space between the tube 80 and the inner core 38. Thus, reciprocation of the overcap 22 on the container 24 pressurizes the air and liquid pressure chambers, 28 and 26, respectively.

Returning to FIG. 4, the separate air and liquid flows enter the air 56 and the liquid passages 58, respectively, of actuator 30 upon exiting the valve assembly 54. The actuator 30 includes an outer housing 86 which is friction fit onto the upper reciprocating element 64 of the valve assembly 54. The outer housing 86 includes portions of the air passage and the liquid passage 58 which mate with those portions of the passages, 56 and 58, respectively, in the valve assembly 54, without the need for orientation. An inner housing 88 is friction fit into the smaller diameter portion of a cavity in the outer housing 86 (again, without the need for orientation) such that the air passage 56 continues down the center of the inner housing 88 and exits through an injection means (in this case, two injection orifices 90); and such that the liquid passage 58 continues in an annular gap 92 between the inner housing 88 and the outer housing 86. An orifice housing 94 is friction fit into the larger diameter section of the cavity at a distance from the inner housing 88 which is slightly larger than the annular gap 92, thereby forming a mixing chamber portion 96 of the gap 92 (which has a slightly higher static pressure than that of the annular gap 92).

The annular gap 92 between the inner housing 88 and the outer housing 86 is small enough that the velocity of the liquid in this gap 92 is greater than that required to keep bubbles from flowing substantially upstream. Preferably, this annular gap 92 is small enough that capillary action operates to halt the liquid in the annular gap 92 from proceeding into the mixing chamber 96 when the valve assembly 54 is closed. Preferably, the halting point of the capillary action is located at about the location of the air injection orifices 90; and more preferably, the halting point is located a distance upstream of the air injection orifices 90. The capillary action helps to ensure a quick termination of liquid flow upon closing the valve assembly 54 allowing for clean shut-off (i.e., with virtually no dripping or spitting).

Air flows into the mixing chamber 96 of this embodiment through two injection orifices 90 located in the tapered distal end of the inner housing 88. A spacially uniform spray pattern is provided by spacially uniformly distributing the air injection orifices 90 (and consequently, the bubbles) within the liquid relative to the final exit orifice 95. Thus, a maximum number of injection orifices 90 located symmetrically relative to the final exit orifice 95 and equidistant from the final exit orifice 95 is preferred. The number of injection orifices 90 may be limited by the need for turbulence in the air stream as it passes through the injection orifices 90, as discussed below. It should also be noted that better atomization is believed to occur when the air injection orifices 90 are located away from a position directly behind the final exit orifice 95 and away from the outer edge of the inner housing 88. Thus, such a configuration is preferred.

It should be noted that the previously described configuration; i.e., with the liquid passage outside and the air passage inside, is highly preferred. The pressure of the air leaving the injection orifices 90 must be slightly greater (e.g., about one to two psig) than the pressure of the liquid in the mixing chamber 96. Preferably, any relative pressure adjustment is made utilizing a restriction on the air (not liquid) passage 56; e.g., at an entry orifice 98 of the inner housing 88.

The air provided to the mixing chamber 96 through the injection orifices 90 must form bubbles. It has been determined that bubble formation is significantly aided by the presence of turbulence in the air exiting the injection orifices 90. Although not wishing to be bound by theory, it is theorized that the turbulence in the air flow induces jet instabilities which cause the air jet to break up into bubbles. Consequently, the air passing through the injection orifices 90 is preferably in turbulent flow; and (although surface roughness and flow disturbances could alter the exact number) more preferably, the air passing through the injection orifices 90 has a Reynolds number of at least about 1,600; and most preferably, has a Reynold number of at least about 2,000. The Reynolds number may be defined by the following equation for round injection orifices:

$$Re=(4\dot{m})/(\pi\mu D\ n)$$

where;

Re is the Reynolds number, dimensionless $\dot{m}$ is the air mass flow rate, kg/s $\mu$ is the air viscosity, N.sec/m$^2$ D is the orifice diameter, m n is the number of injection orifices Thus, for a particular air mass flow rate (m), the area of the injection orifices 90 ($D^2/4$) and the number of injection orifices 90 (n) may be manipulated to achieve a preferred Reynolds Number (Re).

In addition, the air provided to the mixing chamber 96 through the injection orifices 90 must form bubbles such that substantially all of the bubbles exiting the final exit orifice 95 have a diameter greater than about the diameter of the final exit orifice 95. Although not wishing to be bound by theory, it is believed that the reason substantially all of the bubbles must have diameters greater than about the diameter of the final exit orifice 95 is because these large bubbles are essentially squeezed through the final exit orifice 95, creating a thin annular film. As the bubbles exiting the final orifice 95 explode, they create ligaments approximately equal in size to the thickness of the annular liquid film which are then broken up by traditional Weber break-up.

Creating bubbles whose diameters are substantially all greater than about the diameter of the final exit orifice 95 results in an interesting phenomenon which is counterintuitive. Higher surface tension liquids produce smaller particles as measured by the Sauter mean diameter. Again, not wishing to be bound by theory, it is believed that the ligaments of higher surface tension liquids are shorter, since the wavelength which is optimum for break-up is shorter and this wave phenomenon is believed to provide a primary break-up mechanism for this nozzle. The present invention also works well with high viscosity liquids, i.e., above about 10 cP, at the relatively low air-to-liquid ratio and the relatively low chamber pressures discussed herein. In fact, excellent spray qualities may be achieved at viscosities of at least about 80 cP as the liquid passes through the spray device while still operating within the above parameters.

Factors which can influence bubble size include mixing chamber 96 size, liquid viscosity, liquid surface tension, injection orifice 90 size, air and liquid flow rates. For example, the mixing chamber 96 must be large enough that bubbles of this magnitude can form therein. On the other hand, the time it takes a bubble to travel from the air injection point (i.e., orifices 90) to the final exit orifice 95 is also important to bubble size at the final exit orifice 95. This time must be small enough that the bubbles do not coalesce such that separated flow results; i.e., the air must not flow through the liquid in one unbroken stream, or vice versa. If a bubbly flow regime or a slug flow regime is predicted by the geometry of the actuator 30 and the flow rates and physical properties of the air and liquid involved utilizing the calculations provided below, one skilled in the art would expect that bubble coalescence would not be a concern. On the other hand, if a flow regime other than bubbly flow or or slug flow is predicted, one skilled in the art would expect that the air would flow through the liquid in one unbroken stream, or vice versa. Since bubbles would not be present in this case, poor atomization would result. Quite unexpectedly, however, good atomization can be achieved when flow regimes other than bubbly flow or slug flow are predicted; provided the bubbles are not given a chance to coalesce significantly (i.e., such that the air flows through the liquid in one unbroken stream, or vice versa). It is important to note that consumer product flow rates do not lend themselves to an actuator 30 geometry which would predict a bubbly flow regime or a slug flow regime and still permit the desired bubble formation. This is due to the fact that the passages tend to be so small at these low flow rates that bubbles can't form therein.

Thus, it is important when a bubbly flow regime or a slug flow regime is not predicted to eject the air and liquid mixture from the mixing chamber 96 through the exit orifice 95 before the bubbles have a chance to coalesce significantly. Increasing the velocity of the air and liquid mixture in the mixing chamber 96 favorably reduces the time bubbles have to coalesce; however, the liquid velocity must be less than that velocity at which the required large bubble formation is substantially inhibited. The shape and volume of the mixing chamber 96 also can impact the ability of bubbles to coalesce. In addition, the distance traveled by the bubble before exiting the exit orifice 95 is important.

One way to express this distance is in terms of a mean flow path which is defined as the minimum distance between the midpoint of the downstream side of the bubble injection orifice 90 and the midpoint of the upstream side of the final exit orifice 95. If there is more than one injection orifice 90, or a porous material is utilized, the average of all of the distances is equal to the mean flow path. Since the bubbles tend to coalesce significantly as they travel along the mean flow path unless the air and liquid mixture is flowing in the bubbly or slug flow regimes, it is important the keep the mean flow path to a minimum. On the other hand, this distance must be large enough that bubbles are able to form within the mixing chamber 96. Thus, the mean flow path is preferably less than the distance at which the bubbles have time to coalesce significantly; more preferably, the mean flow path is between about 0.24 inch and about 0.01 inch; even more preferably, the mean flow path is between about 0.02 inch and about 0.125 inch; and most preferably the mean flow path is about 0.075 inch.

Figure 6:
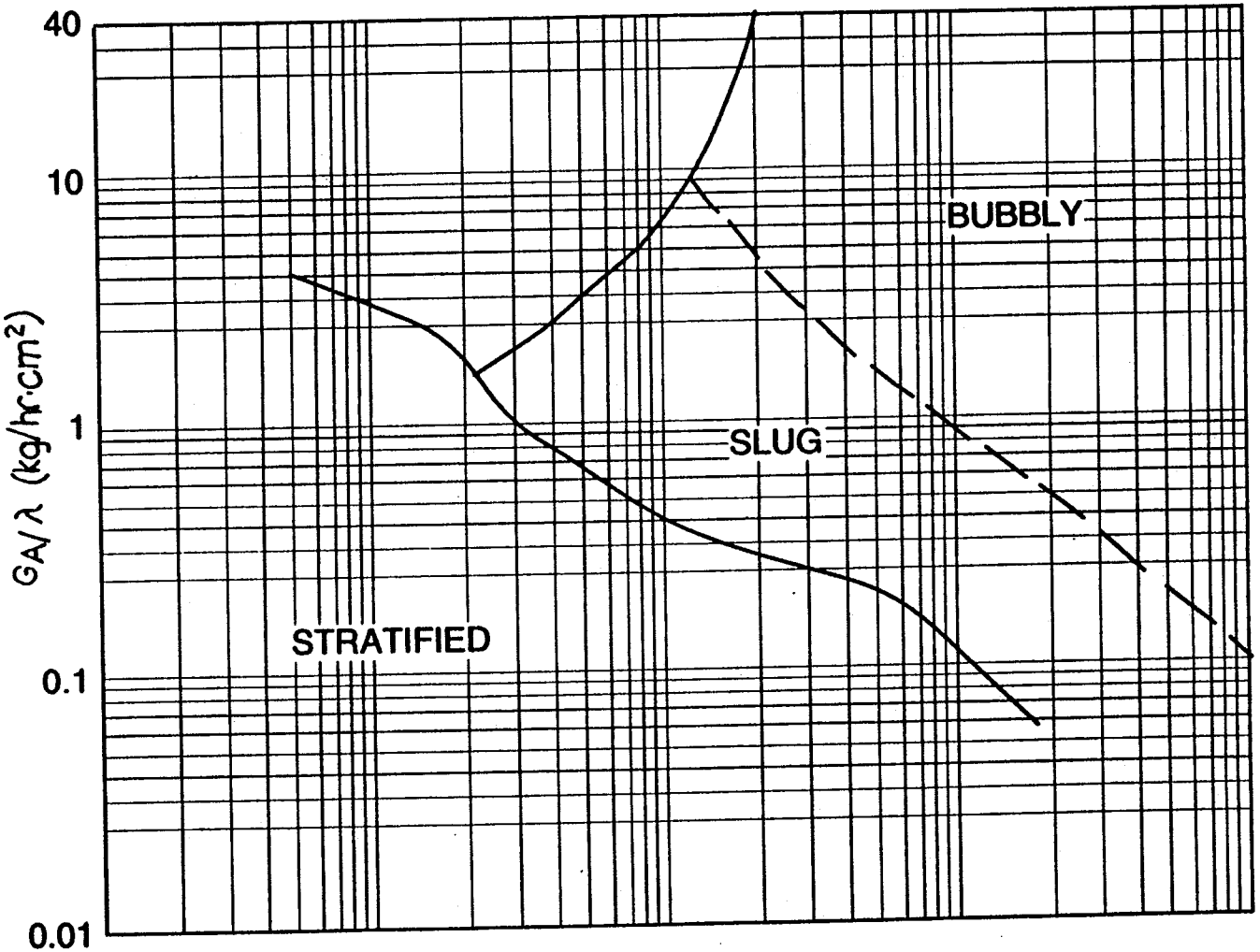
FIG. 6 is the air and liquid mixture flow map for use in determining the predicted flow regime.

The following calculation steps illustrate how to determine what flow regime is predicted by the geometry of the actuator 30 and the flow rates and physical properties of the air and liquid involved using the flow map of FIG. 6. The average cross-sectional area of the mixing chamber can be determined by measurement. In addition, the average mass flow rate of the liquid can be determined by spraying a typical dose of the consumer product and dividing the mass of liquid ejected by the time over which the dose was ejected. Likewise, the mass flow rate of the air can be determined by using a totalizing air flow meter and pressure regulator to determine the volume of air required to return the package to its original internal pressure minus the volume of air required to replace the expelled liquid dose, converting the air volume to air mass and dividing by the time period.

1) Calculate the average mass fluxes of the air and the liquid using equations (1) and (2), respectively.
2) Calculate the normalizing quantities of and using equations (3) and (4), respectively.
3) Calculate the quantity of $G_A/\lambda$ for the y-axis and the quantity $(G_L \cdot \lambda \cdot \Psi)/G_A$ for the x-axis.

$$G_A = \dot{m}_A / A \quad (1)$$

$$G_L = \dot{m}_L / A \quad (2)$$

$$\lambda = (\rho' A \cdot \rho' L)^{\frac{1}{2}} \quad (3)$$

$$\Psi = (\sigma' L)^{-1} (\mu' L)^{\frac{1}{2}} (\rho' L)^{-\frac{3}{2}} \quad (4)$$

where;

$G_A$=mass flux of air, kg/hr.cm$^2$ $G_L$=mass flux of liquid, kg/hr.cm$^2$ $\dot{m}_A$=mass flow rate of air, kg/hr $\dot{m}_L$=mass flow rate of liquid, kg/hr A=total cross-sectional flow area, cm$^2$ $\rho'$A=ratio of air density to air density at standard conditions $\rho'$L=ratio of liquid density to water density at standard conditions $\sigma'$L=ratio of liquid surface tension to water surface tension at standard conditions $\mu'$L=ratio of liquid viscosity to water viscosity at standard conditions 4) Plot coordinates on the graph of FIG. 6 and read the flow map to determine which flow regime is predicted.

Thus, the equilibrium flow regime can be predicted for the air and liquid mixture as it flows through the mixing chamber.

The entire air passage and the entire liquid passage must be appropriately sized based upon the predetermined pressure in the air and liquid pressure chambers to provide the desired relatively low air-to-liquid ratio. Thus, the air-to-liquid ratio of the mixture exiting the final exit orifice 95 must be between about 0.06:1 and about 0.01:1 on a mass basis; and preferably, between about 0.04:1 and about 0.01:1 on a mass basis.

The final exit orifice 95 is sized to provide flow rates typical of consumer product packages at desired low operating pressures. It is worth noting that the length of the exit orifice 95 divided by the diameter of the final exit orifice 95 should be about one (1) to reduce the energy loss through the exit orifice 95. Desirable consumer product flow rates are less than about 1.0 cubic centimeter per second; and more preferably, between about 0.1 cubic centimeter per second and about 0.8 cubic centimeter per second. In addition, the combination of the velocity of the two phase flow through the exit orifice 95 and the air-to-liquid ratio is preferably less than that required to provide choked flow.

Consumer product spray packages incorporating the present invention produce spray through the exit orifice 95 having excellent spray qualities. Consequently, the Sauter mean diameter is preferably less than about 100 microns; and more preferably, between about 70 microns and 20 microns. In addition, the particle size distribution width, expressed in terms of the Rosin-Rammler distribution parameter "q", is preferably greater than about 1.7; and more preferably, greater than about 2.0. A higher "q" represents a more monodispersed spray. Sauter mean diameter and "q" are measured utilizing a Malvern 2600 particle size analyzer with a 300 mm focal length lens. Taking all measurements by passing the laser beam through the center of the spray at a distance of 15 cm downstream from the final injection orifice, the Malvern 2600 particle size analyzer can reduce the data by fitting the scattered light profile to a Rosin-Rammler drop-size distribution and report the information in terms of Sauter mean diameter and "q".

Figure 7:
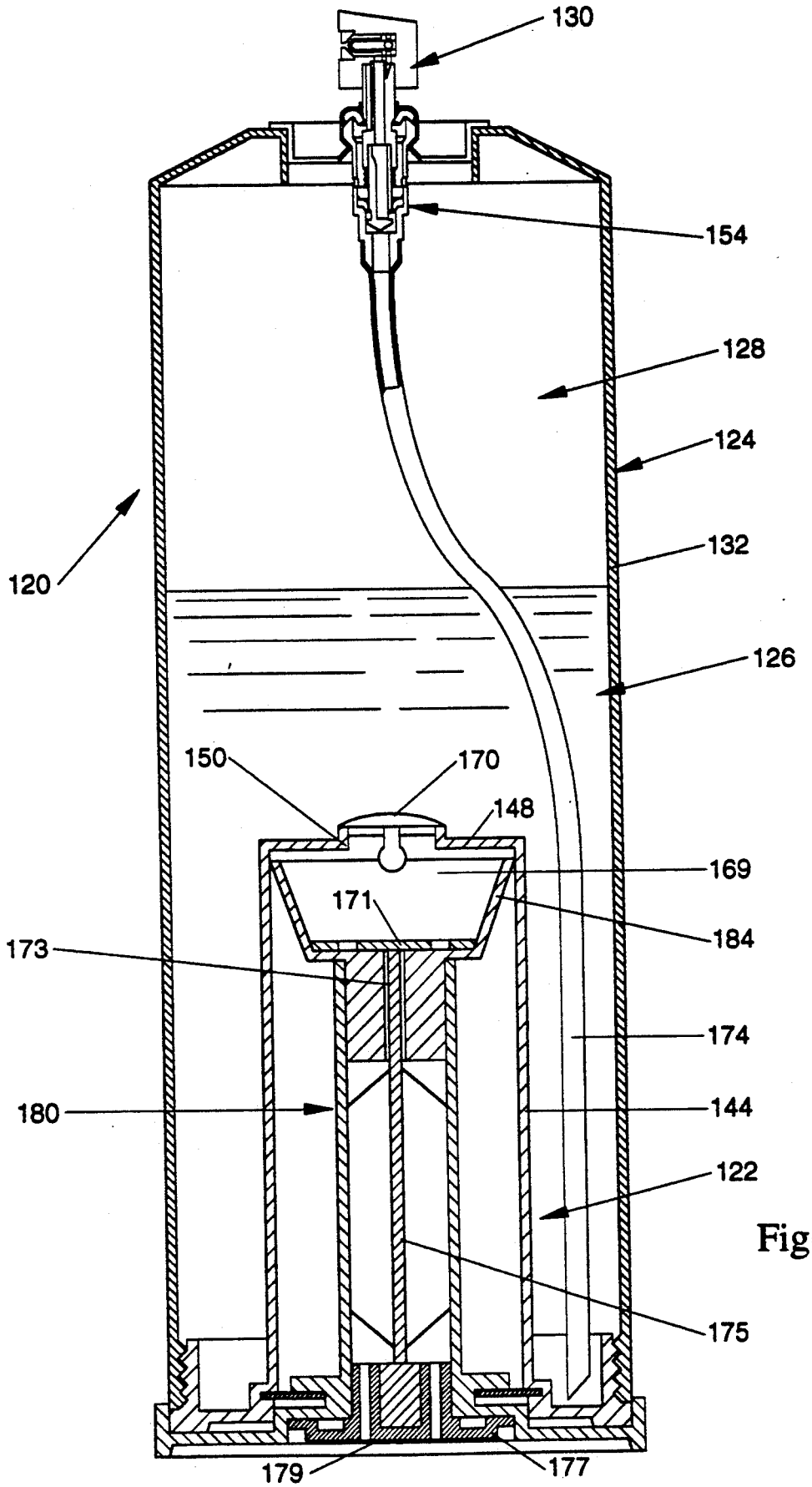
FIG. 7 is a cross-sectional view similar to FIG. 2 illustrating another embodiment of a pump and spray consumer product package of the present invention.
Figure 8:
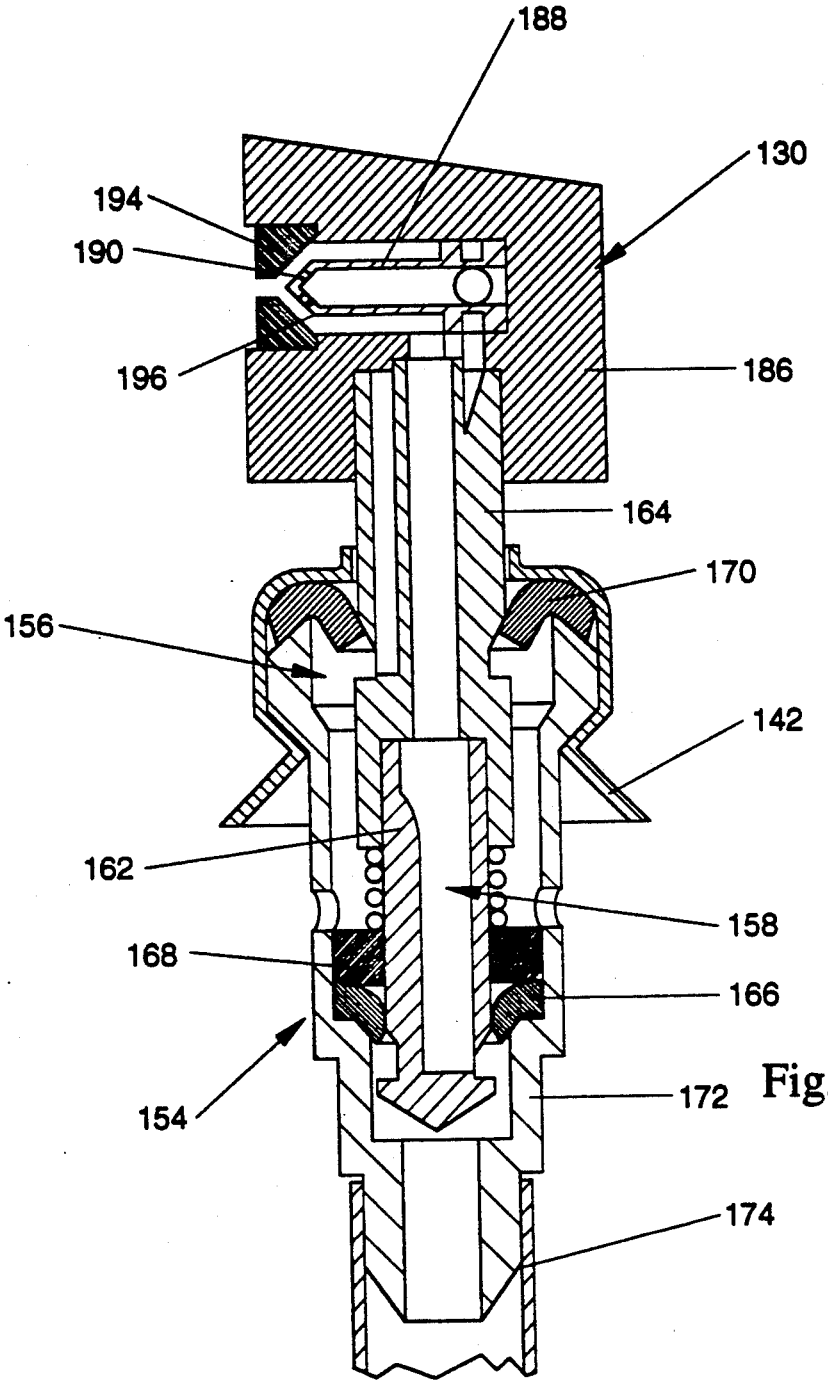
FIG. 8 is an enlarged fragmentary cross-sectional view similar to FIG. 3 of the actuator and valve assembly of the FIG. 7.

Another pump and spray package, indicated generally as 120, of the present invention, indicated generally as 120, is illustrated in FIGS. 7 and 8. This pump and spray package 120 is pressurized utilizing a pumping means 122 located in the bottom wall of the container 132. Examples of such bottom pumping means are disclosed in U.S. Pat. No. 3,955,720 which issued to Malone on May 11, 1976, in U.S. Pat. No. 4,165,025 which issued on Aug. 21, 1979 to Mascia, and U.S. Pat. No. 4,492,320 which issued to Tada on Jan. 8, 1985; the disclosures of which are hereby incorporated herein by reference.

Basically, the illustrated bottom pumping means includes an inner cylindrical wall 144 closed at the upper end by top wall 148 including an opening 150 sealed by a one-way umbrella valve 170. A reciprocating element 180 is sealed at its top end against the inner surface of the cylindrical wall 144 by a cup seal wall 184. As the reciprocating element 180 is moved downwardly, air enters an air compression chamber created between the cylindrical wall 144 and the reciprocating element 180 by passing around the cup seal wall 184. As the reciprocating element 180 is moved upwardly, the air in the compression chamber is compressed, forcing it to enter the package through opening 150, past the one-way umbrella valve 170.

A pressure release means for manually releasing any pressure in the compression chamber 169 remaining after the air and liquid pressure chambers (128 and 126, respectively) are completely pressurized is also provided. The pressure release means includes a resilient member 171 which seals an opening 173 at the distal end of an elongate member 175. The distal end of the elongate member 175 is normally held away from the resilient member 171 by a second resilient member 177. Upon manual actuation (i.e., pressing upon the second resilient member 177) the distal end of the elongate member 175 pushes the sealing resilient member 171 away from the opening 173. This permits the escape of residual excess air pressure from the compression chamber 169 to the atmosphere through orifices after pressurization is complete.

Referring to FIG. 8, with the pressurization means in the bottom of the container 132, the valve assembly 154 provides an on/off mechanism for only two passages; the air passage 156 and the liquid passage 158. Consequently, this valve assembly 154 does not include the air inlet apertures 50 in the top wall 48 as seen FIG. 3, nor the apertures 61 in the outer housing 72. Otherwise, this valve assembly 154 is virtually identical to the one discussed previously. Likewise, the actuator 130 is identical to the actuator 30 previously discussed.

Exemplary dimensions which could be utilized with the above embodiment are provided below. The free end of the inner housing, 188 may have an outer diameter of 0.105 inches and an inner diameter of 0.045 inches. The outer housing 186 mat have an inner diameter of 0.125 inches. This allows a 0.010 inch gap for liquid flow between the inner housing 188 and the outer housing 186. The inner housing 188 is friction fit into the outer housing 186 such that the mean flow path for the bubbles mat be between about 0.010 inch and about 0.240 inch. The two injection orifices 190 may have a diameter 0.007 inch and a length of about 0.01 inch. The final exit orifice 195 might have a diameter of about 0.013 inch and a length of about 0.013 inch. The overall external dimensions of the actuator may be about 0.5 inches in length and about 0.6 inches in diameter.

Figure 9:
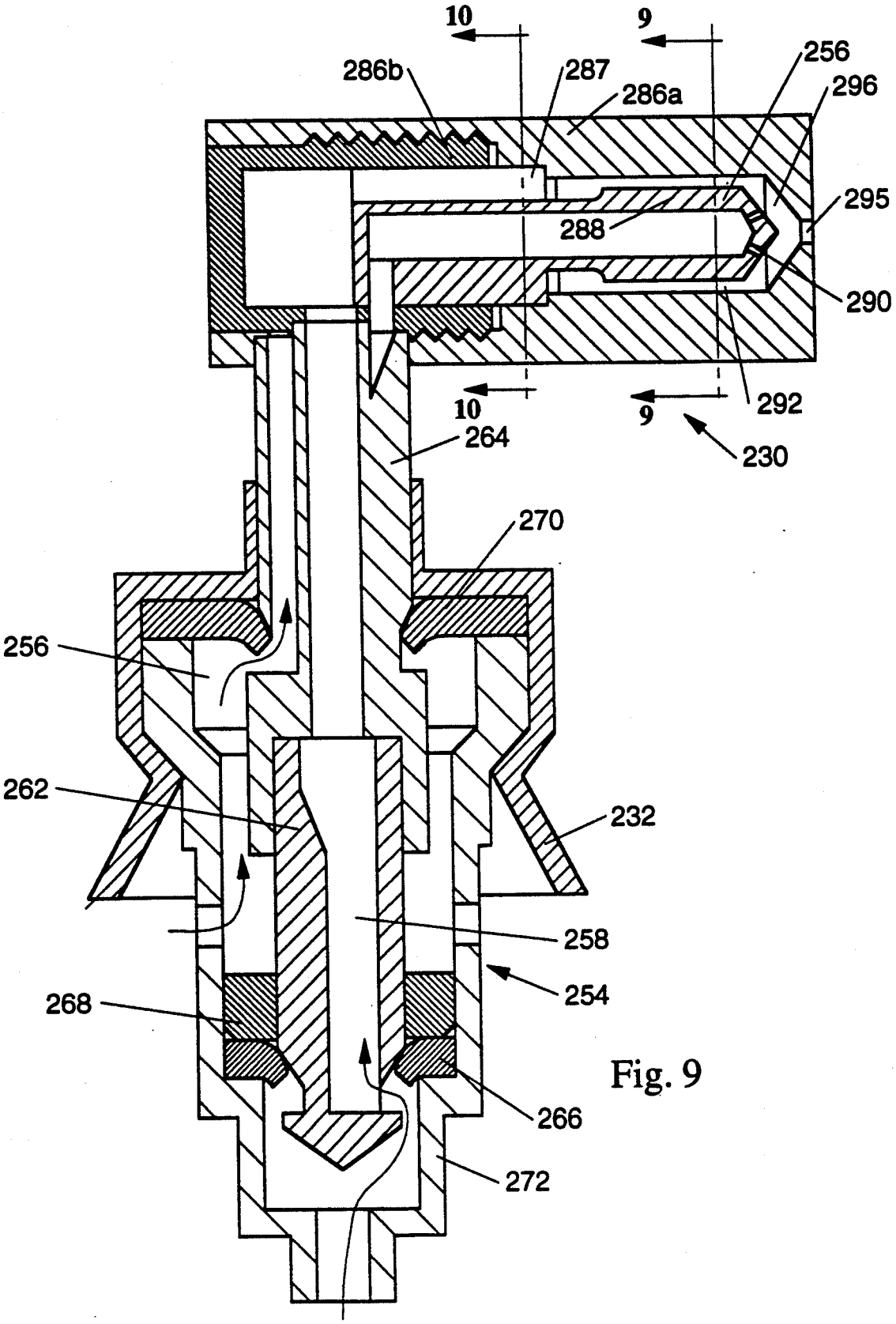
FIG. 9 is an enlarged cross-sectional view similar to FIG. 3 of a preferred embodiment of an aerosol consumer product package of the present invention.

Referring to FIG. 9, the valve assembly 254 and actuator 230 of a preferred aerosol package of the present invention is illustrated. This package is essentially a standard precharged aerosol package. The valve assembly 254 of this package is virtually identical to the valve assembly 154 of FIG. 8. The actuator 230 of this embodiment is of a slightly modified configuration than that previously discussed.

The actuator 230 includes an outer housing which is a combination of parts 286*a* and 286*b* which are threaded together (hereinafter referred to as outer housing 286). The outer housing 286 has a cavity which is essentially a two step bore with a 45 degree countersink. Concentric with the countersink portion of the cavity is the final exit orifice 295. The final exit orifice 295 is sized to provide consumer product liquid flow rates as discussed above. This outer housing 286 may be made of any material which is substantially nonporous and can be shaped accordingly, including metal such as brass, and plastics such as polyethylene, polyacetal, and polypropylene.

Figure 11:
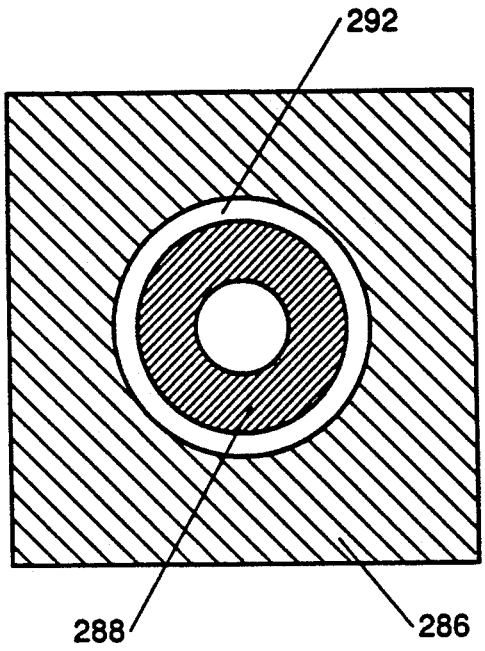
FIG. 11 is a cross-sectional view of the actuator taken along line 11—11 of FIG. 9.
Figure 10:
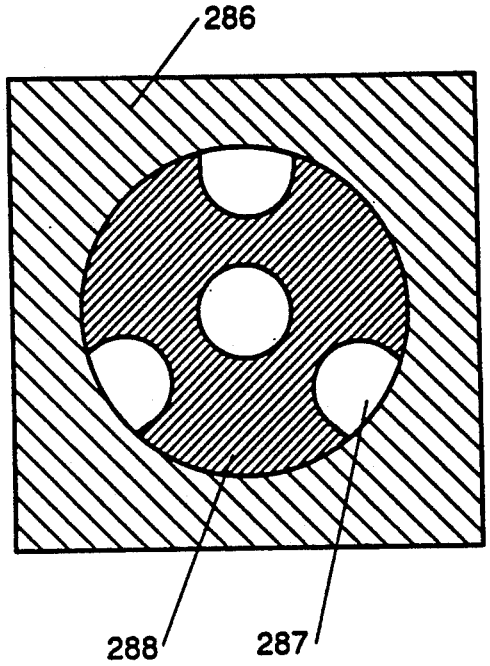
FIG. 10 is a cross-sectional view of the actuator, taken along line 10—10 of FIG. 9.

An inner housing 288 may be made of any substantially nonporous material (note, however, that the injection orifice 290 may be a porous portion of the inner housing 288). The exemplary materials given above with regard to the outer housing 286 are also applicable to the inner housing 288. The inner housing 288 has a larger diameter and a smaller diameter portion. Referring to FIG. 11, the larger diameter portion of the inner housing 288 is substantially the same diameter as the larger bore portion of cavity of the outer housing 286 to provide a fluid tight seal between the periphery of the two. Three liquid flow channels 287, however, are provided equally spaced around the circumference of the inner housing 288 and extend throughout the larger diameter portion of the inner housing 288 and partially along the smaller diameter portion thereof. Referring to FIG. 10, the outer diameter of the smaller diameter portion of the inner housing 288 is sized to create a liquid flow gap 292 between itself and the outer housing 286, as previously discussed. The distal end of the inner housing 288 is tapered to a point on a 45 degree bevel (seen best in FIG. 9). Although this tapered configuration is preferred for manufacturing reasons, the distal end of the inner housing and the cavity of the outer housing 286 near the exit orifice 295 could be squared off.

Internally, as seen in FIG. 9, a cavity which is essentially a concentric countersink bore is located in the inner housing 288 to provide the air flow passage 256. Preferably, two injection orifices 290 are provided having the same diameter and length through the distal end of the inner housing 288, leading into the mixing chamber 296. The injection orifices 290 are centered between the point and the break of the bevel directly across from each other. These injection orifices 290 are adapted to function as previously discussed herein. In addition, these injection orifices 290 are located relative to the final exit orifice 290 as previously discussed herein.

Exemplary dimensions which could be utilized with the above embodiment are provided below. The larger step bore portion of the outer housing 286 may have a diameter of about 0.09 inch and the smaller step bore portion may have a diameter of about 0.08 inch. The final exit orifice 295 might have a diameter of about 0.015 inch and a length of about 0.03 inch.

The inner housing 288 is friction fit into the outer housing 286 such that the mean flow path may be between about 0.24 inch and about 0.01 inch. Internally, the countersink bore of the inner housing 288 may have a diameter of about 0.09 inch and the two injection orifices 290 may each have a diameter of about 0.007 inch and a length of about 0.01 inch. Externally, the larger diameter portion of the inner housing 288 may be about 0.65 inch in length and have an outer diameter of about 0.09 inch (i.e., equal to the larger diameter portion of the inner housing). The smaller diameter portion of the inner housing 288 may have a length of about 0.194 inch (including the bevel portion) and an outer diameter of about 0.06 inch. These dimensions would create an annular liquid flow gap 292 of about 0.01 inch between the inner housing 288 and the outer housing 286. The three liquid flow channels 287 may extend a length of about 0.7 inch and may have a radius of about 0.017 inch and extend about 0.027 inch deep radially.

Figure 12:
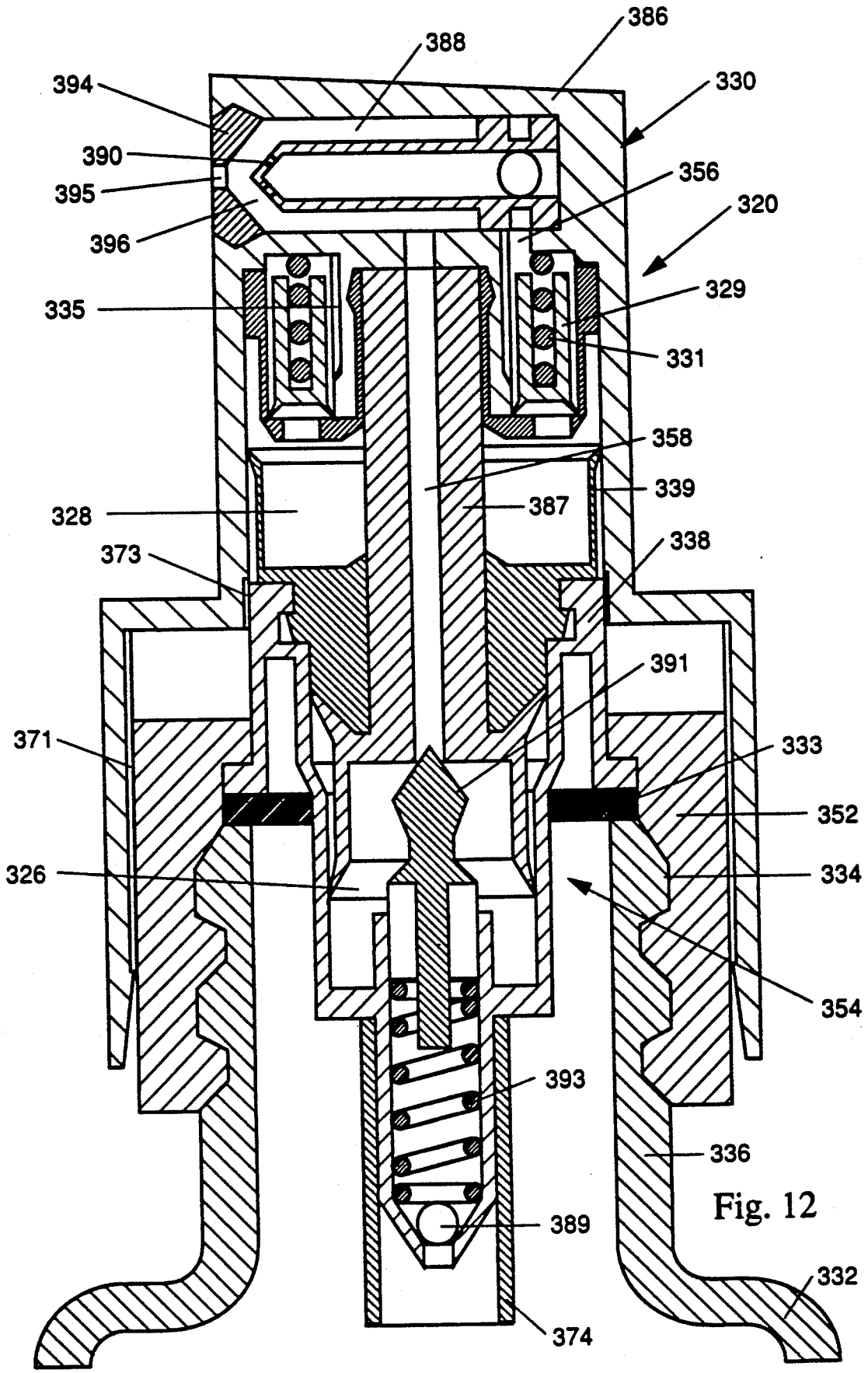
FIG. 12 is an enlarged cross-sectional view similar to FIG. 3 of a preferred embodiment of a finger pump consumer product package incorporating a spray device of the present invention.

FIG. 12 illustrates a preferred embodiment of a finger pump consumer product package of the present invention, indicated generally as 320. The container 332 includes a neck portion 336 which has external screw threads 334. The finger pump and valve assembly 354 includes an inner core 338 which is sealed on the package utilizing an o-ring 333 and an annular collar 352. These parts (i.e., the o-ring 333, inner core 338 and the annular collar 352) and a cup seal member 339 remain stationary relative to the container 332 during operation. An actuator 330 is provided which includes an outer housing 386, an inner housing 388 and an orifice housing 394 which correspond substantially in relation similar parts discussed previously with regard to FIG. 4.

Focussing first on the liquid flow passage 358, once primed, liquid is located in this passage 358 up to the capillary halting point, as discussed above. As the outer actuator housing 386 is reciprocated downwardly, a reciprocating member 387 is also forced downwardly compressing the liquid in a liquid compression chamber 326 (i.e., the liquid pressure chamber) between itself and a ball check valve 389. A plunger 391 initially seals the liquid flow passage 358 at the lower end of the reciprocating member 387. This plunger 391 is configured such that as the pressure in the liquid compression chamber 326 increases, the pressure forces the plunger 391 down against a spring 393. This spring 393 is designed to maintain the plunger 391 in sealed relation against the reciprocating member 387 until a predetermined pressure is reached inside the liquid compression chamber 326. Once the predetermined pressure is reached, the plunger 391 moves away from the reciprocating member 387 and the liquid passes on through the liquid passage 358.

Turning now to the air flow passage 356, downward actuation of the outer actuator housing 386 simultaneously causes air to become compressed in an air compression chamber 328 (i.e., the air pressure chamber). As the air is compressed it pushed up against two cup seal plungers 329 which in turn push against springs 331. As the plungers 329 move up against the springs 331 they reach a grove 335 in the wall of the housing 386 which permits the air to pass into the cavity of the inner housing 388 through an aperture as previously discussed. The elements such as the springs 331 and 333, grooves 335 and compression chambers 326 and 328 are sized and configured such that the air will be released from the air compression chamber 328 substantially simultaneously as the liquid is released from the liquid compression chamber 326 and such that the desired air-to-liquid ratio is obtained.

As the outer actuator housing 386 is released, air returns through a pair of lower grooves 371 and a pair of upper grooves 373 and is pulled into the air compression chamber 328 around the periphery of the cup seal member 339. Likewise, as the outer actuator housing 386 is released, the reciprocating member 387 returns toward its original position due to the spring 393, and liquid is pulled into the liquid compression chamber 326 through a diptube 374 and around the ball check valve 389.

Figure 13:
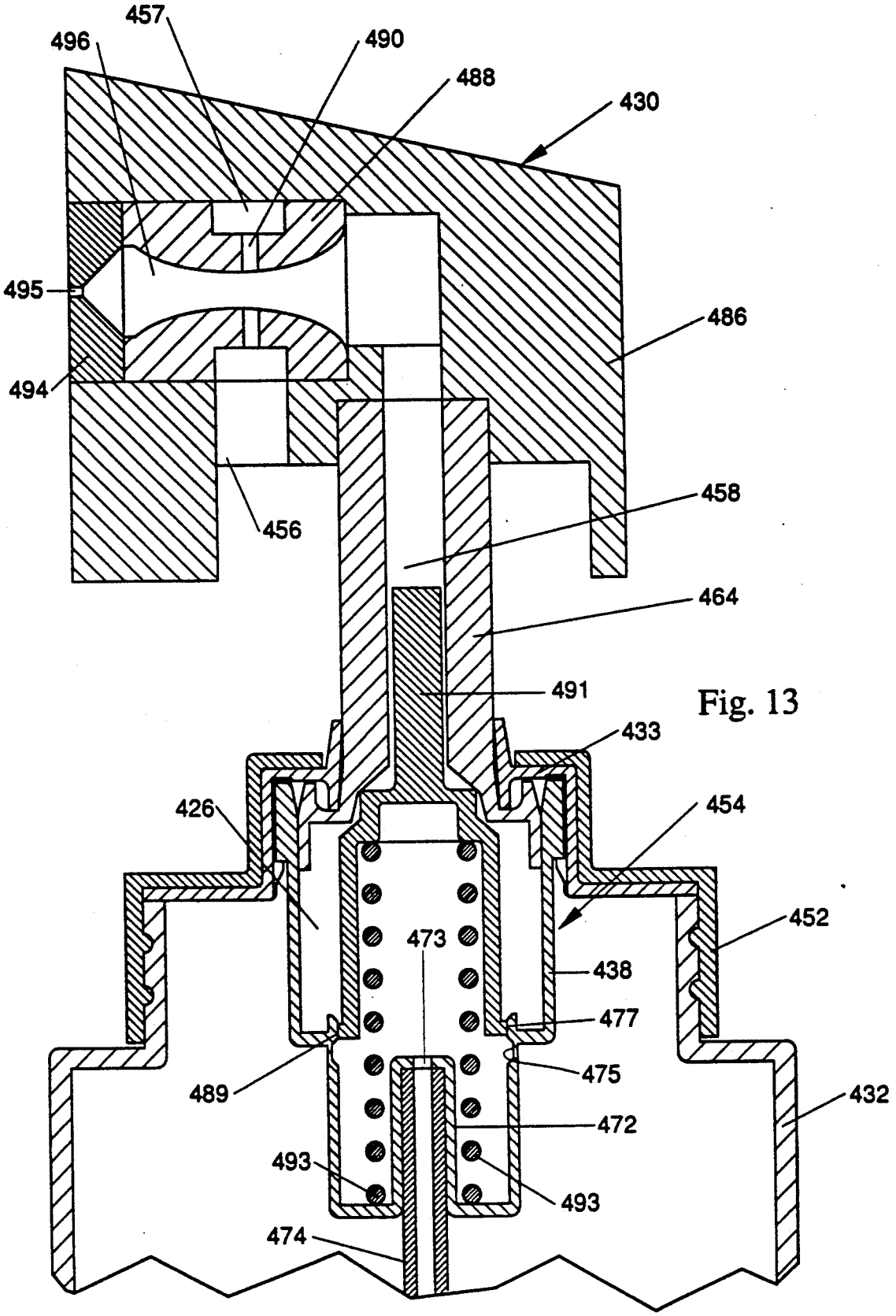
FIG. 13 is an enlarged cross-sectional view similar to FIG. 3 of a preferred embodiment of a finger pump consumer product package incorporating a spray device of the present invention including a venturi shaped mixing chamber.

FIG. 13 illustrates a second preferred embodiment of the present invention utilized in a finger pump package, indicated generally as 420. The actuator 430 of this embodiment includes a venturi shaped mixing chamber 496 which draws air into the mixing chamber 496 through two injection orifices 490 from the atmosphere. Thus, the air pressure chamber 428 of this embodiment is the atmosphere. The finger pump package 420 includes a pumping mechanism 454 which is identical to that disclosed in U.S. Pat. No. 5,020,696 issued to Cater on Jun. 4, 1991; the disclosure of which is hereby incorporated herein by reference. Although not required, such a precompression pumping mechanism 454 is preferred.

Briefly, the pumping mechanism 454 includes a closure 452, a stem 464, a resilient member 433, a valve member 491, a spring 493, a pump body 438 and a dip tube 474. The pump body 438 has an upper cylindrical portion and a lower cylindrical portion. The lower cylindrical portion of the pump body 438 includes an inner cylinder 472 which operates to frictionally retain the dip tube 474. At the upper end of the inner cylinder 472 is an aperture 473 which provides fluid communication between the dip tube 474 and the interior of the pump body 438. The interior of the lower cylindrical portion of the pump body 438 includes an annular groove 475 and an annular sealing member 477. The valve member 491 includes an annular sealing member 489 at its lower end which mates with the annular sealing member 477 of the lower cylindrical portion of the pump body 438. The valve member 491 is biased upwardly by the spring 493 which in turn biases the stem 464 upwardly. The stem 464 also functions as the piston for the pumping mechanism 454.

Telescoped onto the stem 464 of the pumping mechanism 454 is an actuator 430. The actuator 430 includes an inner housing 488 which is friction fit into a stepped bore located in an outer housing 486. The inner housing 488 includes a recessed channel 456 which extends radially around the entire circumference of the inner housing 488. Located at substantially the midpoint of an inner venturi passage through the center of the inner housing 488, a portion of which operates as the mixing chamber 496, and extending from the recessed channel 457 are two air injection orifices 490. The outer housing 486 includes an air passage 456 which mates with the recessed channel 456 to provide fluid communication between the atmosphere and the mixing chamber 496. Friction fit into the open end of the step bore of the outer housing 486 is a housing 494 having a final exit orifice 495 therethrough.

The bottle 432 of this package 420 houses a liquid which is drawn into the pumping mechanism 454 through the dip tube 474. As the actuator 430 is reciprocated downwardly, the stem 464 and valve member 491 begin to move downwardly against the spring 493. Thus, the volume of the liquid pressure chamber 426 created by the upper portion of the pump body 438, the valve member 491 and the stem 464 begins to shrink. This causes the pressure within this liquid pressure chamber 426 to rise until the downward force created by this pressure on the valve member 491 exceeds the upward force on the valve member 491 due to the spring 493.

Figure 14:
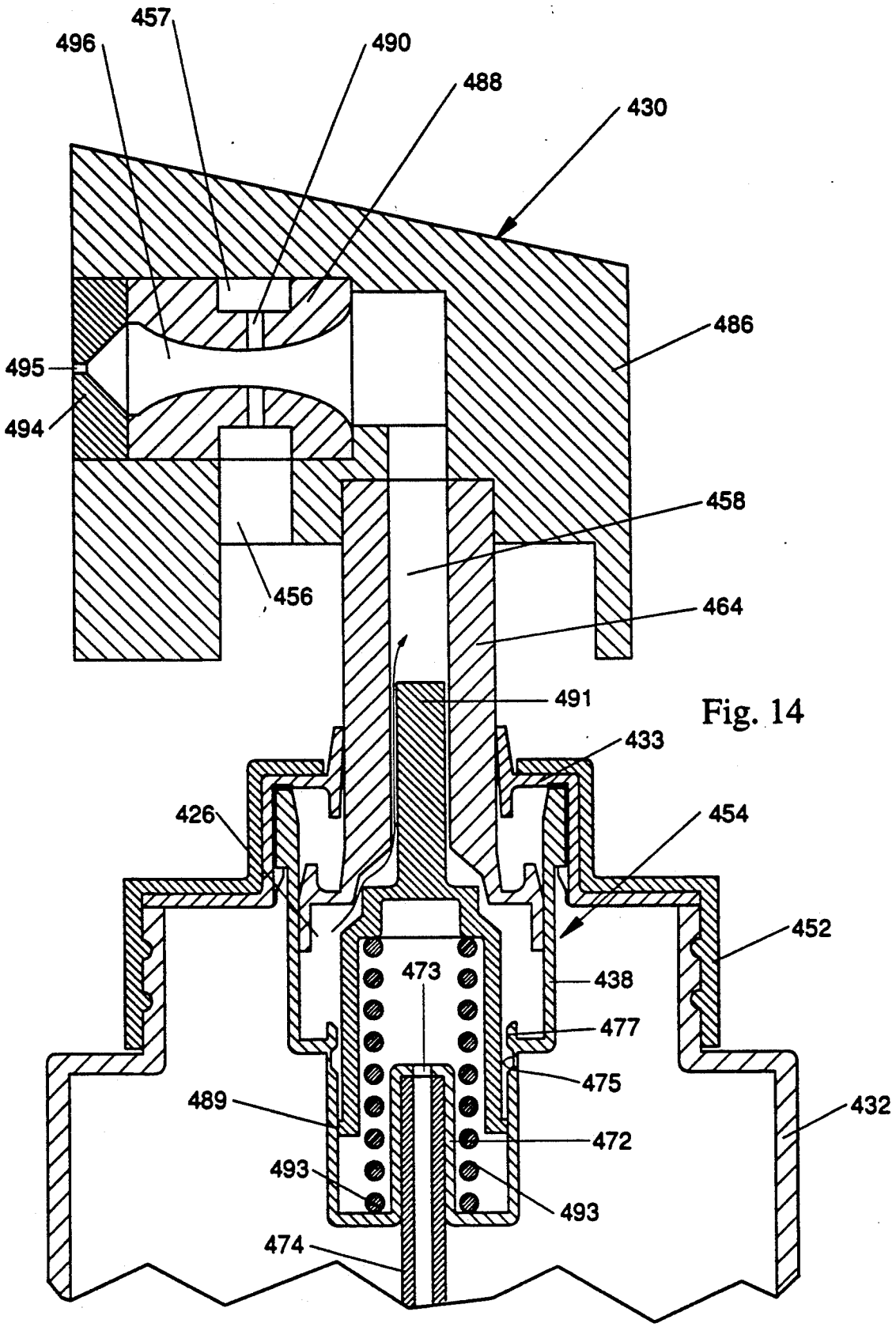
FIG. 14 is an enlarged cross-sectional view similar to FIG. 3 illustrating the actuator and valve assembly with the liquid passage open during spraying.

Referring to FIG. 14, this causes the valve member 491 to move away from the stem 464 creating a liquid passage 458 between these two parts and permitting the liquid to escape through the passage 458 in the stem 464. The liquid then enters the actuator 430 and passes through the venturi shaped mixing chamber 496. The venturi shaped mixing chamber 496 increases the velocity of the liquid such that the pressure of the liquid is decreased below atmospheric pressure, thereby sucking air into the liquid flow path through the injection orifices 490.

To accomplish this goal the velocity of the liquid near the walls of the venturi shaped mixing chamber 496 needs to be relatively large. In addition, it is desirable to maintain the size of the venturi shaped mixing chamber 496 as large as possible at its midpoint to reduce energy losses and prevent clogging. Thus, a relatively flat velocity profile of the liquid is preferred. A flat velocity profile will ensure that the pressure at the centerline as well as near the walls will be at the required low pressure. Since flatter velocity profiles are found when the liquid is in turbulent flow (as opposed to laminar flow), turbulent liquid flow through the venturi shaped mixing chamber 496 is preferred. The included angle on the tapered section should also be around 40 degrees to prevent flow separation disrupting the velocity profile as well as to minimize the flow losses. Additionally, or alternatively, the velocity profile may be flattened by coating the venturi shaped mixing chamber 496 with a low surface friction polymer, such as Teflon.

As the air enters the liquid in the mixing chamber 496 through the injection orifices 490, the bubbles flow in the diverging section of the mixing chamber 496 to increase the pressure of the bubbles and allow them to disperse. The two-phase flow then flows a previously specified optimum distance to the exit orifice 495.

As the actuator 430 is released, the stem 464 moves in the vertically upward direction in response to the force of the spring 493. A negative pressure is then created within the expanding liquid pressure chamber 426 which opposes the force of the spring 493. The force of the spring 493 is chosen so that it is insufficient to fully return the valve member 491 and the stem 464 to their topmost position as long as the force of the spring 493 is opposed by the force exerted on the stem 464 by the negative pressure. The negative pressure within the liquid pressure chamber 426 is relieved as the annular sealing member 489 passes the annular groove 475. At this moment, the liquid is drawn into the liquid pressure chamber 426, the downward force on the stem 464 due to the negative pressure is removed, and the force of the spring 493 is sufficient to return the stem 464 and the valve member 491 to their topmost position.

Figure 15:
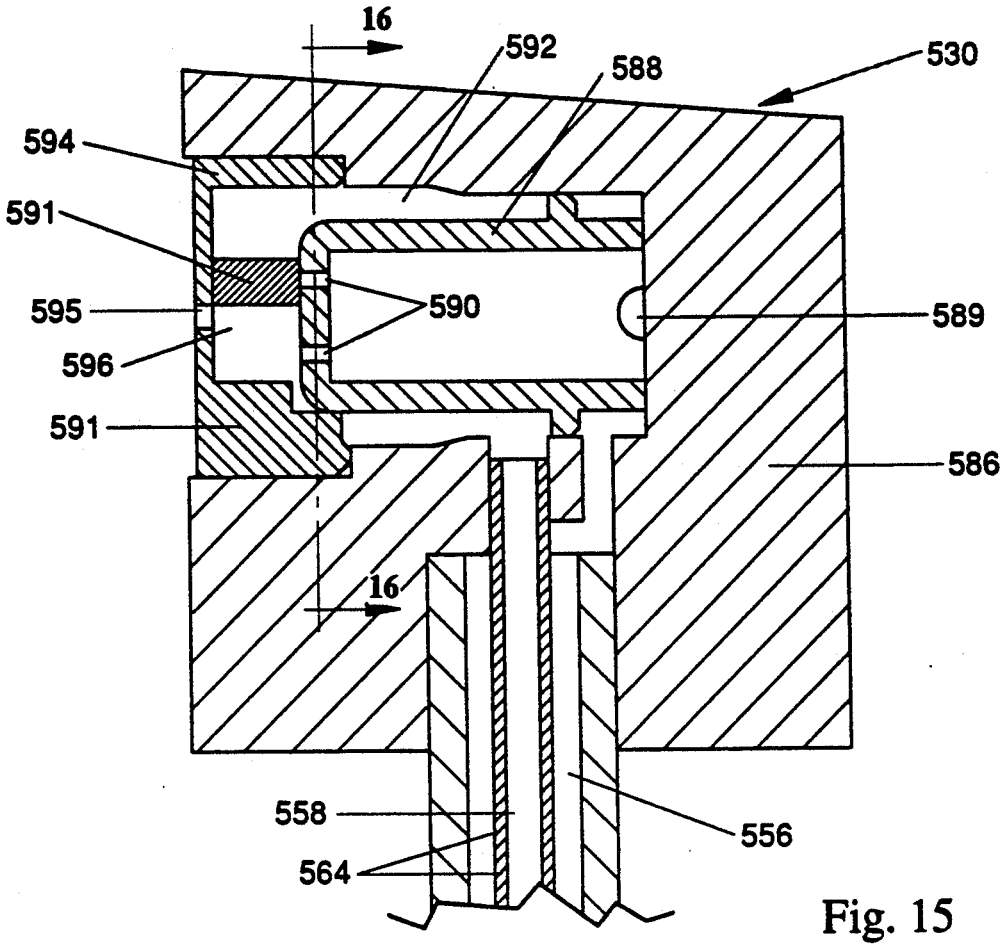
FIG. 15 is an enlarged cross-sectional view similar to FIG. 3 of a preferred embodiment of an accuator for the spray device of the present invention.
Figure 16:
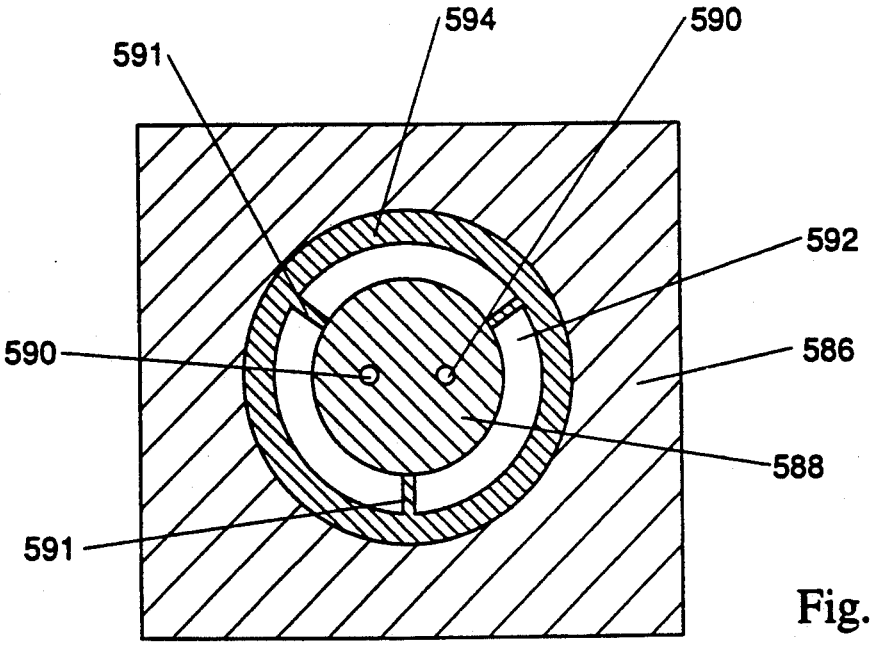
FIG. 16 is a fragmentary cross-sectional view of the accuator taken along FIG. 16—16 of FIG. 15.

Referring to FIG. 15 and 16, an alternative preferred actuator, indicated generally as 530, for use with the present invention is illustrated. The actuator 530 includes an outer housing 586 which is friction fit onto the stem 564 of a container (not seen), such as previously described. The outer housing 586 includes portions of the air passage 556 and the liquid passage 558. An inner housing 588 is friction fit into a cavity in the outer housing 586 (without the need for orientation) such that the air passage 556 continues down the center of the inner housing 588 and exits through an injection means. The air passes into the center of the inner housing 588 through a notch 589 in the end of the inner housing 588 which is relatively simple to mold. The air injection means in this case are two injection orifices 590 which may be molded, drilled or otherwise formed in the distal end of the inner housing 588. The liquid passage 558 continues in an annular gap 592 between the inner housing 588 and the outer housing 586. An orifice housing 594 is friction fit into a large diameter section of the outer housing 586 cavity. The orifice housing 594 includes three radially spaced fins 591 which contact the distal end of the inner housing 588 to maintain the inner housing 588 in its appropriate axial orientation. The mixing chamber 596 is formed between the distal end of the inner housing 588 and the orifice housing 594 which contains a final exit orifice 595. The parameters and preferences previously disclosed with respect to the embodiments described above are also applicable to this embodiment.

Figure 17:
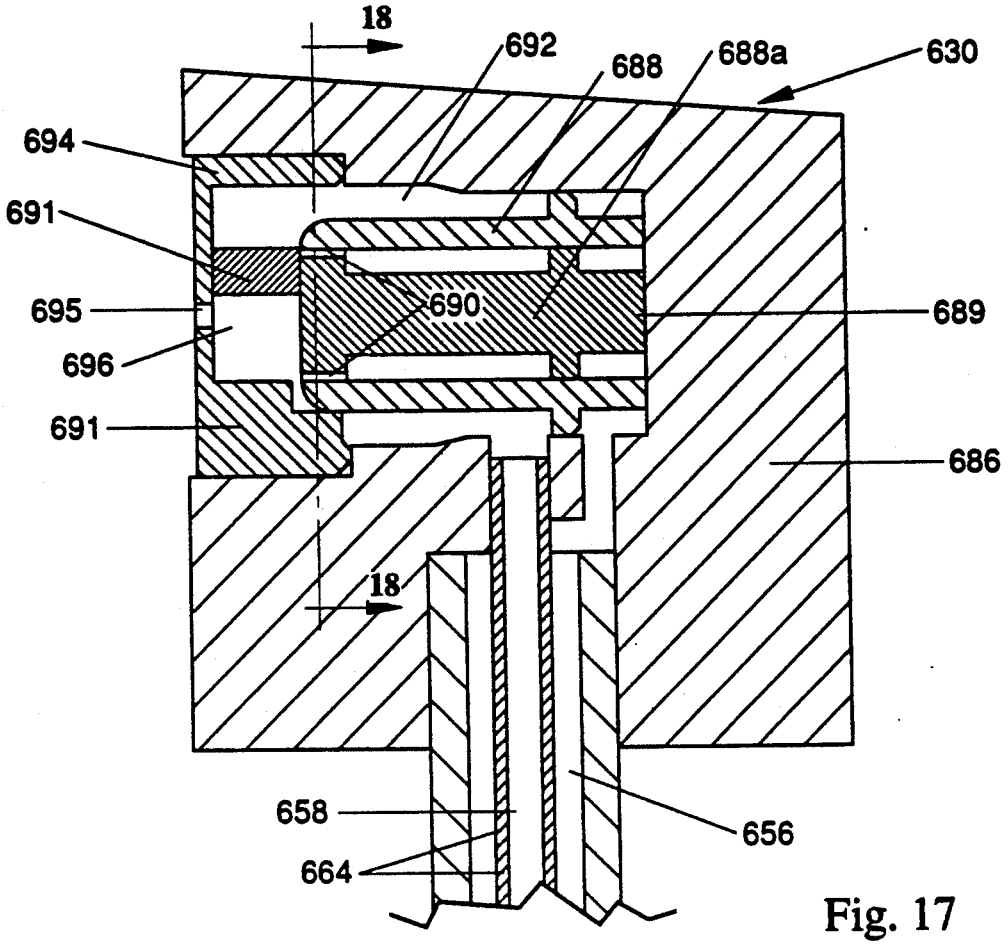
FIG. 17 is an enlarged fragmentary cross-sectional view similar to FIG. 15 illustrating another preferred accuator for the spray device of the present invention.
Figure 18:
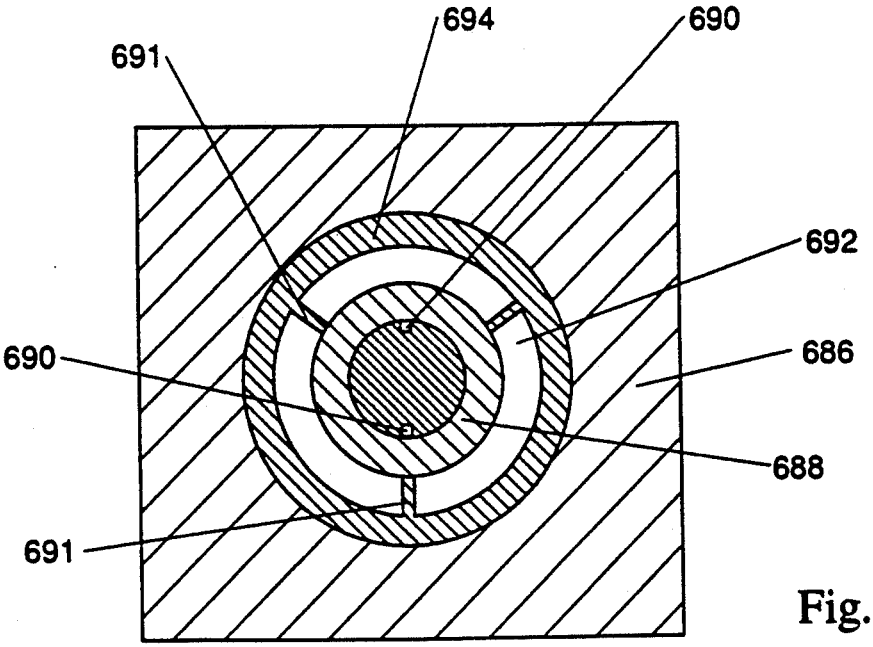
FIG. 18 is an enlarged fragmentary cross-sectional view of the accuator taken along line 18—18 of FIG. 17.

Referring to FIG. 16 and 17, another alternative preferred actuator, indicated generally as 630, for use with the present invention is illustrated. The actuator 630 includes an outer housing 686 which is friction fit onto the stem 664 of a container (not seen), such as previously described. The outer housing 686 includes portions of the air passage 656 and the liquid passage 658. An inner housing 688 is friction fit into a cavity in the outer housing 686 (without the need for orientation) such that the air passage 656 continues down the center of the inner housing 688 and exits through an injection means. The inner housing 688 includes a core element **688*a* which has radial ribs 689 on one end and two notches which form injection orifices 690 at the other end. The air passes into the center of the inner housing 688 through a notch 689 in the end of the inner housing which is relatively simple to mold and passes down the length of the inner housing 688 past the ribs 687. The air injection means in this case are two injection orifices 690 which are formed between the inner housing 688 and the core element 688*a* at the notches. The liquid passage 658 continues in an annular gap 692 between the inner housing 688 and the outer housing 686. An orifice housing 694 is friction fit into a large diameter section of the outer housing 686 cavity. The orifice housing 694 includes three radially spaced fins 691 which contact the distal end of the inner housing 688 to maintain the inner housing 688 in its appropriate axial orientation. The mixing chamber 696 is formed between the distal end of the inner housing 688 and the orifice housing 694** which contains a final exit orifice. The parameters and preferences previously disclosed with respect to the embodiments described above are also applicable to this embodiment.

Although particular embodiments of the present invention have been shown and described, modification may be made to the spray device and package without departing from the teachings of the present invention. For example, a trigger sprayer pumping mechanism could also be utilized with such spray device. Accordingly, the present invention comprehends all embodiments within the scope of the appended claims.

What we claim is:

1. A package for spraying consumer products incorporating a mixing chamber for mixing air and liquid, the package comprising:

(a) a liquid and an air pressure chamber located in communication with the mixing chamber via a liquid passage and an air passage, respectively, the liquid and the air pressure chamber having a pressure less than about 50 psi immediately prior to dispensing, the liquid passage and the air passage being sized to provide air-to-liquid ratios to the mixing chamber between about 0.06:1 and about 0.01:1 on a mass basis;

(b) a valve means, located along the liquid passage and the air passage intermediate the liquid and the air pressure chambers and the mixing chamber, for selectively opening and closing the liquid passage and the air passage, respectively; and (c) an actuator including:

(i) an outer housing having a cavity therein, the outer housing also including a portion of the liquid passage, a portion of the air passage and a final exit orifice, each of which provides separate communication to the cavity through the outer housing, the final exit orifice being dimensioned to provide liquid flow rates less than about 1.0 cubic centimeter per second; and (ii) an inner housing located within the cavity of the outer housing, the exterior dimensions of the inner housing being adapted to provide a portion of either the liquid passage or the air passage in a gap between the inner housing and the outer housing, the mixing chamber being located in that portion of the gap closest to the final exit orifice; the inner housing having a cavity therein providing a portion of the other of the liquid passage or the air passage, the inner housing including a bubble injection means providing a portion of the air passage between the small cavity of the inner housing and the mixing chamber, the injection means being for forming bubbles such that substantially all of the bubbles have diameters which are greater than about the diameter of the exit orifice.

2. A package for spraying consumer products incorporating a mixing chamber for mixing air and liquid, the package comprising:

(a) a liquid and an air pressure chamber located in communication with the mixing chamber via a liquid passage and an air passage, respectively, the liquid and the air pressure chamber having a pressure less than about 50 psi immediately prior to dispensing, the liquid passage and the air passage being sized to provide air-to-liquid ratios to the mixing chamber between about 0.06:1 and about 0.01:1 on a mass basis;

(b) a valve means, located along the liquid passage and the air passage intermediate the liquid and the air pressure chambers and the mixing chamber, for selectively opening and closing the liquid passage and the air passage, respectively; and (c) an actuator including:

(i) an outer housing having a cavity therein, the outer housing also including a portion of the liquid passage, a portion of the air passage and a final exit orifice, each of which provides separate communication to the cavity through the outer housing, the final exit orifice being dimensioned to provide liquid flow rates less than about 1.0 cubic centimeter per second; and (ii) an inner housing located within the cavity of the outer housing, the exterior dimensions of the inner housing being adapted provide a portion of the liquid passage in a gap between the inner housing and the outer housing, the mixing chamber being located in that portion of the gap closest to the final exit orifice; the inner housing having a cavity therein providing a portion of the air passage, the inner housing including a bubble injection means providing a portion of the air passage between the small cavity of the inner housing and the mixing chamber, the injection means being for forming bubbles such that substantially all of the bubbles have diameters which are greater than about the diameter of the exit orifice.

3. A package for spraying consumer products according to claim 1, wherein the distance between the injection orifice and the final exit orifice expressed in terms of a mean flow path is less than the distance at which bubbles coalesce significantly.

4. A package for spraying consumer products according to claim 2, wherein the distance between the injection orifice and the final exit orifice expressed in terms of a mean flow path is less than the distance at which bubbles coalesce significantly.

5. A package for spraying consumer products according to claim 1 wherein the distance between the injection orifice and the final exit orifice expressed in terms of a mean flow path is between about 0.24 inch and about 0.01 inch.

6. A package for spraying consumer products according to claim 2 wherein the distance between the injection orifice and the final exit orifice expressed in terms of a mean flow path is between about 0.24 inch and about 0.01 inch.

7. A package for spraying consumer products according to claim 3, wherein the liquid flow passage is adapted to provide flow rates in the annular gap such that the bubbles are prevented from flowing substantially upstream.

8. A package for spraying consumer products according to claim 4, wherein the liquid flow passage is adapted to provide flow rates in the annular gap such that the bubbles are prevented from flowing substantially upstream.

9. A package for spraying consumer products according to claim 7, wherein the annular gap portion of the liquid flow passage is small enough that capillary action occurs such that the halting point of the capillary action is located at about the location of the air injection means.

10. A package for spraying consumer products according to claim 8, wherein the annular gap portion of the liquid flow passage is small enough that capillary action occurs such that the halting point of the capillary action is located at about the location of the air injection means.

11. A package for spraying consumer products according to claim 9, wherein the air injection means are orifices located symmetrically relative to the final exit orifice and equidistant from the final exit orifice.

12. A package for spraying consumer products according to claim 10, wherein the air injection means are orifices located symmetrically relative to the final exit orifice and equidistant from the final exit orifice.

13. A package for spraying consumer products according to claim 3, wherein the valve means is adapted to substantially simultaneously open and close the air passage and the liquid passage.

14. A package for spraying consumer products according to claim 4, wherein the valve means is adapted to substantially simultaneously open and close the air passage and the liquid passage.

15. A package for spraying consumer products according to claim 3, wherein the air has a turbulence as it passes through the air injection means expressed in terms of a Reynolds number above about 1600.

16. A package for spraying consumer products according to claim 4, wherein the air has a turbulence as it passes through the air injection means expressed in terms of a Reynolds number above about 1600.

17. A package for spraying consumer products according to claim 11, wherein the air has a turbulence as it passes through the air injection means expressed in terms of a Reynolds number above about 1600.

18. A package for spraying consumer products according to claim 12, wherein the air has a turbulence as it passes through the air injection means expressed in terms of a Reynolds number above about 1600.

19. A package for spraying consumer products according to a mixing chamber for mixing air and liquid, the package comprising,:

(a) a means for delivering the liquid to the mixing chamber;

(b) a means for separately delivering the air to the mixing chamber through an air injection means;

(c) an exit orifice through which the air and liquid from the mixing chamber exits the package, the distance from the injection means to the exit orifice expressed in terms of a mean flow path being less than the distance at which bubbles have a chance to coalesce significantly; and wherein the exit orifice, the liquid delivery means, and the air delivery means cooperate to provide a total mass flow rate less than about 1.0 cubic centimeter per second, a mass flow rate of the liquid, and a mass flow rate of the air such that along with the average cross sectional area of the mixing chamber, the surface tension of the liquid, the viscosity of the liquid, the density of the liquid and the density of the air, the plot of $G_A/\lambda$ verses $(G_L \cdot \lambda \cdot \Psi)/G_A$ on the graph of FIG. 6 falls outside of the bubbly flow regime and the slug flow regime.

20. A package for spraying consumer products according to claim 19 wherein the distance between the injection orifice and the final exit orifice expressed in terms of a mean flow path is between about 0.24 inch and about 0.01 inch.

21. A package for spraying consumer products according to claim 19, wherein the air injection means are orifices located symmetrically relative to the final exit orifice and equidistant from the final exit orifice.

22. A package for spraying consumer products according to claim 20, wherein the air injection means are orifices located symmetrically relative to the final exit orifice and equidistant from the final exit orifice.

23. A package for spraying consumer products according to claim 19, wherein the air has a turbulence as it passes through the air injection means expressed in terms of a Reynolds number above about 1600.

24. A package for spraying consumer products according to claim 20, wherein the air has a turbulence as it passes through the air injection means expressed in terms of a Reynolds number above about 1600.

25. A package for spraying consumer products according to claim 21, wherein the air has a turbulence as it passes through the air injection means expressed in terms of a Reynolds number above about 1600.

26. A package for spraying consumer products according to claim 22, wherein the air has a turbulence as it passes through the air injection means expressed in terms of a Reynolds number above about 1600.

* * * * *

UNITED STATES PATENT AND TRADEMARK OFFICE

CERTIFICATE OF CORRECTION

PATENT NO. : 5,323,935

DATED : June 28, 1994

INVENTOR(S) : Peter G. Gosselin et al

It is certified that error appears in the above-identified patent and that said Letters Patent is hereby corrected as shown below:

Column 12, line 50, "mat" should read -- may --.

Column 12, line 55, "mat" should read -- may --.

Column 20, lines 17-18, "according to" should read -- incorporating --.

Signed and Sealed this

Tenth Day of April, 2001

*Attest:*

Nicholas P. Godici

NICHOLAS P. GODICI

*Attesting Officer*

*Acting Director of the United States Patent and Trademark Office*